US011353048B2

(12) United States Patent
Fukuda et al.

(10) Patent No.: US 11,353,048 B2
(45) Date of Patent: Jun. 7, 2022

(54) WORKING MACHINE

(71) Applicant: KUBOTA CORPORATION, Osaka (JP)

(72) Inventors: Yuji Fukuda, Osaka (JP); Daiki Abe, Osaka (JP); Ryota Hamamoto, Osaka (JP); Kazuki Ueda, Osaka (JP); Kohei Kurachi, Osaka (JP); Yuya Konishi, Osaka (JP); Masaki Inaoka, Osaka (JP); Yasushi Otagaki, Osaka (JP); Yuya Tanabe, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/395,894

(22) Filed: Aug. 6, 2021

(65) Prior Publication Data

US 2022/0049464 A1 Feb. 17, 2022

(30) Foreign Application Priority Data

Aug. 15, 2020 (JP) ..... JP2020-137179
Aug. 15, 2020 (JP) ..... JP2020-137194
Aug. 15, 2020 (JP) ..... JP2020-137195

(51) Int. Cl.
*F15B 21/0423* (2019.01)
*E02F 9/22* (2006.01)

(52) U.S. Cl.
CPC ..... *F15B 21/0423* (2019.01); *E02F 9/226* (2013.01); *E02F 9/2235* (2013.01); *E02F 9/2267* (2013.01); *E02F 9/2282* (2013.01); *E02F 9/2292* (2013.01); *F15B 2211/62* (2013.01)

(58) Field of Classification Search
CPC ..... F15B 21/0423; F15B 2211/62
See application file for complete search history.

(56) References Cited

U.S. PATENT DOCUMENTS 6,681,568 B2 * 1/2004 Smith ..... F15B 11/162 60/456
6,769,252 B2 * 8/2004 Smith ..... F15B 11/0423 60/456
6,845,614 B2 * 1/2005 Stahlman ..... F04B 53/08 137/884
6,959,671 B2 * 11/2005 Nakagawa ..... E02F 9/226 123/41.12

(Continued)

FOREIGN PATENT DOCUMENTS

JP 10-68142 A 3/1998
JP 2016-145493 A 8/2016

*Primary Examiner* — Michael Leslie
(74) *Attorney, Agent, or Firm* — Greenblum & Bernstein, P.L.C.

(57) ABSTRACT

A working machine includes a fan motor driven with hydraulic fluid, the fan motor including a first port and a second port, a bypass fluid passage connecting the first port of the fan motor and the second port to each other, a flow rate control valve provided on the bypass fluid passage to control a flow rate of the hydraulic fluid flowing in the bypass fluid passage, a drain passage configured to drain the hydraulic fluid upstream of the flow rate control valve, and an unloading valve shiftable between a full-closing position to close the drain passage and a full-opening position to open the drain passage.

20 Claims, 8 Drawing Sheets

(56) References Cited

U.S. PATENT DOCUMENTS

| | | | | |
|---|---|---|---|---|
| 8,459,959 | B2 * | 6/2013 | Imaizumi | F04B 1/324 60/329 |
| 10,006,188 | B2 * | 6/2018 | Fukuda | B60T 11/21 |
| 2011/0011356 | A1 * | 1/2011 | Tanaka | E02F 9/2296 236/35 |
| 2022/0049464 | A1 * | 2/2022 | Fukuda | E02F 9/2267 |
| 2022/0049729 | A1 * | 2/2022 | Abe | F15B 21/02 |

* cited by examiner

WORKING MACHINE

FIELD OF THE INVENTION

The present invention relates to a working machine.

DESCRIPTION OF THE RELATED ART

A working machine disclosed in Japanese Unexamined Patent Publication No. 2016-145493 is known.

The working machine disclosed in Japanese Unexamined Patent Publication No. 2016-145493 includes a fan motor configured to be driven by hydraulic fluid and rotate a fan, a bypass fluid passage configured to allow the hydraulic fluid to flow by bypassing the fan motor, and a flow rate control valve configured to regulate a flow rate of the hydraulic fluid flowing in the bypass fluid passage. When the flow rate control valve regulates the flow rate of the hydraulic fluid flowing into the bypass fluid passage, rotation of the fan can be regulated.

A working machine disclosed in Japanese Unexamined Patent Publication No. H10-68142 is known.

The working machine disclosed in Japanese Unexamined Patent Publication No. H10-68142 includes a fan motor configured to rotate a fan. The fan is rotated by a hydraulically-driven fan motor to generate air flow. The fan motor can be rotated normally or reversely with a directional control valve switching a flow direction of the hydraulic fluid that drives the fan motor. When the fan motor is rotated normally, the air flow of the fan cools the cooled object, and when the fan motor is rotated reversely, the air flow of the fan blows dusts adhering to the cooled object.

SUMMARY OF THE INVENTION

In the working machine disclosed in Japanese Unexamined Patent Publication No. 2016-145493, there is a case where the flow rate of the hydraulic fluid supplied to the fan motor becomes high when the engine rotation, for example, is high. Even when an attempt is made to reduce the rotation of the fan in this case, the rotation may be hard to be reduced well.

In addition, in the working machine disclosed in Japanese Unexamined Patent Publication No. H10-68142, when a flow rate control valve that regulates a flow rate of the hydraulic fluid to be supplied to the fan motor is incorporated into the motor housing that houses the fan motor, the restriction on forming an internal fluid passage in the motor housing becomes large. As a result, the internal fluid passage may fail to form a sufficient inner diameter, and a pressure loss (loss in horsepower) may be large.

In addition, in the working machine disclosed in Japanese Unexamined Patent Publication No. H10-68142, in switching, for example, a rotation direction of the fan motor from a normal direction to a reverse direction, a surge pressure is generated in hydraulic equipment such as a hydraulic pump disposed upstream of the fan motor when a rotation speed of the fan motor is high at the time of switching.

In view of the above-mentioned problems, a working machine capable of reducing a rotation of a fan well is desired.

In addition, it is desired to reduce a pressure loss in a hydraulic circuit in a working machine that includes a fan motor and a flow rate control valve configured to regulate a flow rate of hydraulic fluid to be supplied to the fan motor.

In addition, a working machine capable of suppressing, in a hydraulic circuit, generation of surge pressures in switching a rotation direction of a fan motor well is desired.

Means of Solving the Problems

In an aspect, a working machine includes a fan motor driven with hydraulic fluid, the fan motor including a first port and a second port, a bypass fluid passage fluidly connecting the first port or vicinity thereof and the second port or vicinity thereof to each other to bypass the fan motor, a flow rate control valve provided on the bypass fluid passage to control a flow rate of the hydraulic fluid flowing in the bypass fluid passage, a drain passage configured to drain the hydraulic fluid upstream of the flow rate control valve, and an unloading valve shiftable between a full-closing position to close the drain passage and a full-opening position to open the drain passage.

In addition, the drain passage is fluidly connected to the bypass fluid passage.

In addition, the unloading valve is shifted from the full-opening position to the full-closing position when the flow rate control valve is open at a predetermined opening degree.

In addition, the flow rate control valve is closed after a predetermined period elapses since the shifted unloading valve reaches the full-closing position.

In addition, the unloading valve is shifted from the full-opening position to the full-closing position while the flow rate control valve open at a predetermined opening degree is gradually closed.

In addition, an opening degree of the flow rate control valve is changed to a predetermined opening degree while the unloading valve is held at the full-opening position.

In addition, the working machine further includes a controller that controls the flow rate control valve and the unloading valve by outputting control signals to the flow rate control valve and the unloading valve. The controller is configured or programed to output a first control signal to the unloading valve so as to hold the unloading valve at the full-opening position, and to output a second control signal to the flow rate control valve so as to set an opening degree of the flow rate control valve to a predetermined opening degree while the unloading valve is held at the full-opening position by the first control signal.

The bypass fluid passage includes a first section fluidly connecting the first port or the vicinity thereof to the flow rate control valve, and a second section fluidly connecting the second port or the vicinity thereof to the flow rate control valve. The drain passage fluidly connects the first section and the second section to each other.

In another aspect, a working machine includes a fan driving device that includes a motor housing including a first introduction port, and a fan motor disposed in the motor housing and configured to rotate with hydraulic fluid introduced into the first introduction port. The working machine includes a fan rotation controller that includes a valve housing disposed apart from the motor housing and including an output port, and a flow rate control valve disposed in the valve housing and configured to control a flow rate of hydraulic fluid introduced into the first introduction port, and an external fluid passage fluidly connecting the first introduction port of the motor housing to the output port of the valve housing.

The working machine further includes a hydraulic pump to deliver the hydraulic fluid. The valve housing includes a second introduction port into which the hydraulic fluid delivered from the hydraulic pump is introduced, and a first internal fluid passage fluidly connecting the output port to the second introduction port and provided thereon with the flow rate control valve.

The valve housing includes a second internal fluid passage fluidly connected to the first internal fluid passage, an unloading valve provided on the second internal fluid passage and shiftable between a full-closing position to close the second internal fluid passage and a full-opening position to open the second internal fluid passage, and a discharge port fluidly connected to the second internal fluid passage and configured to discharge the hydraulic fluid from the second internal fluid passage therethrough.

The first internal fluid passage includes a pump fluid passage fluidly connecting the output port to the second introduction port, and a bypass fluid passage branching from the pump fluid passage to be fluidly connected to the discharge port. The second internal fluid passage includes an unloading fluid passage branching from the pump fluid passage to be fluidly connected to the discharge port.

The fan driving device includes a directional control valve disposed in the motor housing and configured to select a direction of the hydraulic fluid introduced into the fan motor.

In another aspect, a working machine includes a first fan rotated to generate an air flow, a fan motor driven with hydraulic fluid to rotate the first fan, a flow rate control valve to control a flow rate of hydraulic fluid supplied to the fan motor, a directional control valve configured to change a flow direction of the hydraulic fluid for driving the fan motor so as to change a rotation direction of the first fan, and a controller to control the flow rate control valve and the directional control valve. The controller, when changing the flow direction of hydraulic fluid for driving the fan motor, is configured or programmed to gradually open the flow rate control valve until the flow rate control valve becomes fully open to minimize a rotation speed of the first fan, and to output a control signal to the directional control valve to change the rotation direction of the first fan while the rotation speed of the first fan is minimized.

In addition, the working machine further includes an unloading fluid passage to drain the hydraulic fluid supplied to the fan motor, and an unloading valve provided on the unloading fluid passage and shiftable between a full-closing position to close the unloading fluid passage and a full-opening position to open the unloading fluid passage. The controller capable of controlling the unloading valve is configured or programmed to reduce the rotation speed of the first fan to the minimum rotation speed by fully opening the flow rate control valve and by shifting the unloading valve to the full-opening position.

In addition, the controller is configured or programmed to gradually open the flow rate control valve while the unloading valve is set at the full-closing position, and to shift the unloading valve to the full-opening position after the gradually opened flow rate control valve becomes fully open.

In addition, the controller is configured or programmed to shift the unloading valve to the full-closing position and gradually close the flow rate control valve after a predetermined period elapses since the rotation direction of the first fan is changed.

In addition, the working machine further includes a cooled object to be cooled by the first fan, the first fan being disposed on one directional surface side of the first fan, and a second fan disposed on the other directional surface side of the cooled object. The first fan is configured to rotate in a first direction so as to generate a first air flow passing the cooled object from the other directional surface side to the one directional surface side, and to rotate in a second direction opposite to the first direction so as to generate a second air flow passing the cooled object from the one directional surface side to the other directional surface side. The controller is configured or programmed to rotate the second fan in a direction such as to generate the second air flow when the first fan is rotated in the second direction.

In addition, the controller is configured or programmed to rotate the second fan in the foresaid direction when, before or after the reduced rotation speed of the first fan reaches the minimum rotation speed.

In addition, the controller is configured or programmed to output a control signal to the directional control valve so as to change the rotation direction of the first fan after or before the second fan rotates in the foresaid direction.

According to the working machine, a rotation of a fan rotated by a fan motor can be reduced well.

In addition, according to the working machine, a flow rate control valve is housed in a valve housing disposed separately from a motor housing that houses a fan motor, and the flow rate control valve is disposed separately from a fan driving device. In this manner, an inner diameter of an internal fluid passage can be sufficiently formed to reduce a pressure loss in a hydraulic circuit.

In addition, according to the working machine, a flow rate control valve is gradually opened in switching a flow direction of hydraulic fluid to drive a fan motor, and a rotation direction of a first fan is switched in a state where the flow rate control valve is fully opened to reduce a rotation speed of the first fan to the lowest rotation speed. In this manner, generation of surge pressures in a hydraulic circuit can be suppressed well at the time of switching a rotation direction of a fan motor.

DETAILED DESCRIPTION OF THE PREFERRED EMBODIMENTS

An embodiment of the present invention will be described below with reference to drawings.

First, referring to FIGS. 1 to 3, a working machine 1 according to a first embodiment will be described.

Figure 3:
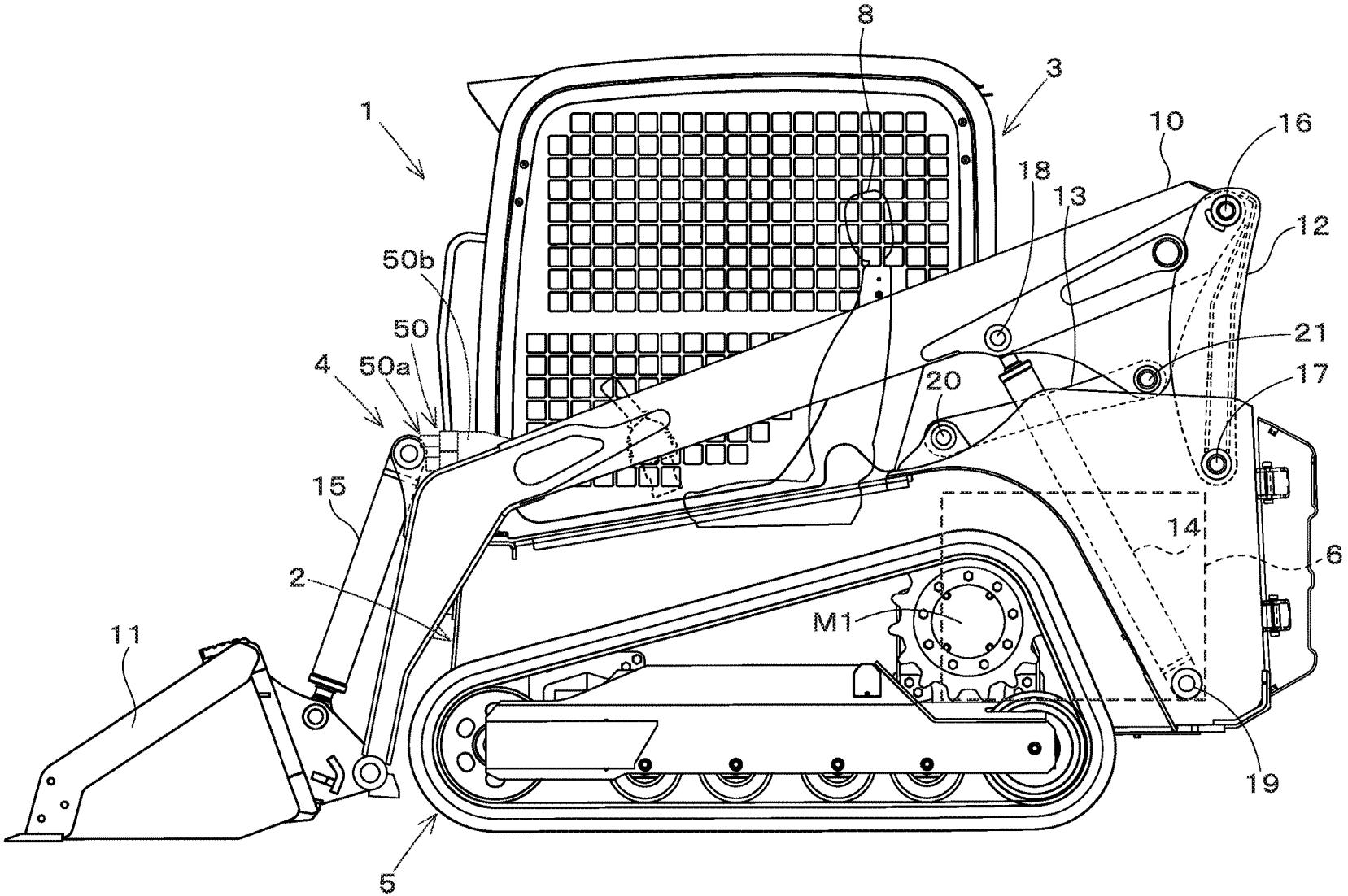
FIG. 3 is a side view of a working machine according to the first embodiment.

FIG. 3 shows a side view of the working machine 1 according to the first embodiment. FIG. 3 shows a compact track loader as an example of the working machine 1. However, the working machine 1 is not limited to a compact track loader, and may be another kind of loader, such as a skid steer loader. The working machine 1 may be a working machine other than the loader.

As shown in FIG. 3, the working machine 1 has a machine body 2, a cabin 3, a working device 4, and a pair of traveling devices 5.

The cabin 3 is mounted on the machine body 2. The cabin 3 incorporates an operator's seat 8 on which an operator sits. The working device 4 is attached to the machine body 2. The pair of traveling devices 5 are disposed on an outside of the machine body 2. A prime mover 6 is mounted internally on a rear portion of the machine body 2.

In the present embodiment, a forward direction from an operator siting on the operator's seat 8 of the working machine 1 (a left side in FIG. 3) is referred to as the front, a rearward direction from the operator (a right side in FIG. 3) is referred to as the rear, a leftward direction from the operator (a front surface side of FIG. 3) is referred to as the left, and a rightward direction from the operator (a back surface side of FIG. 3) is referred to as the right. A horizontal direction orthogonal to a fore-and-aft direction is referred to as a machine width direction (a width direction of the machine body 2). A direction extending from a center portion of the machine body 2 to the right or left is described as a machine outward direction. In other words, the machine outward direction is equivalent to the machine width direction and separates away from the machine body 2. A direction opposite to the machine outward direction is described as a machine inward direction. In other words, the machine inward direction is equivalent to the machine width direction and approaches the center portion of the machine body 2 in the width direction.

The working device 4 is a hydraulically-driven device, and includes booms 10, a working tool 11, lift links 12, control links 13, boom cylinders 14, and bucket cylinders 15.

The booms 10 are disposed on right and left sides of the cabin 3 swingably up and down. The working tool 11 is a bucket 11, for example. The bucket 11 is disposed on tip portions (front end portions) of the booms 10 movably up and down. The lift links 12 and the control links 13 support base portions (rear portions) of the booms 10 so that the booms 10 can be swung up and down. The boom cylinders 14 are extended and contracted to lift and lower the booms 10. The bucket cylinders 15 are extended and contracted to swing the bucket 11.

Front portions of the right and left booms 10 are connected to each other by a deformed connecting pipe. Base portions (rear potions) of the booms 10 are connected to each other by a circular connecting pipe.

The lift links 12, control links 13, and boom cylinders 14 are respectively arranged on right and left sides of the machine body 2 to correspond to the right and left booms 10.

The lift links 12 are disposed vertically from rear portions of the base potions of the booms 10. Upper portions (one ends) of the lift links 12 are pivotally supported on the rear portions of the base portions of the booms 10 via respective pivot shafts 16 (first pivot shafts) rotatably around their lateral axes. In addition, lower portions (the other ends) of the lift links 12 are pivotally supported on a rear portion of the machine body 2 via respective pivot shafts 17 (second pivot shafts) rotatably around their lateral axes. The second pivot shafts 17 are disposed below the first pivot shafts 16.

Upper portions of the boom cylinders 14 are pivotally supported via respective pivot shafts 18 (third pivot shafts) rotatably around their lateral axes. The third pivot shafts 18 are disposed at the base portions of the booms 10, especially, at front portions of the base portions. Lower portions of the boom cylinders 14 are pivotally supported via respective pivot shafts 19 (fourth pivot shafts) rotatably around their lateral axes. The fourth pivot shafts 19 are disposed closer to a lower portion of the rear portion of the machine body 2 and below the third pivot shafts 18.

The control links 13 are disposed in front of the lift links 12. One ends of the control links 13 are pivotally supported via respective pivot shafts 20 (fifth pivot shafts) rotatably around their lateral axes. The fifth pivot shafts 20 are disposed on the machine body 2 forward of the lift links 12. The other ends of the control links 13 are pivotally supported via respective pivot shafts 21 (sixth pivot shafts) rotatably around their lateral axes. The sixth pivot shafts 21 are disposed on the booms 10 forwardly upward from the second pivot shafts 17.

By extending and contracting the boom cylinders 14, the booms 10 are swung up and down around the first pivot shafts 16 with the base portions of the booms 10 being supported by the lift links 12 and the control links 13, thereby lifting and lowering the tip end portions of the booms 10. The control links 13 are swung up and down around the fifth pivot shafts 20 according to the vertical swinging of the booms 10. The lift links 12 are swung back and forth around the second pivot shafts 17 according to the vertical swinging of the control links 13.

An alternative working tool instead of the bucket 11 can be attached to the front portions of the booms 10. The alternative working tool is, for example, an attachment (auxiliary attachment) such as a hydraulic crusher, a hydraulic breaker, an angle broom, an earth auger, a pallet fork, a sweeper, a mower or a snow blower.

A connecting member 50 is disposed at the front portion of the left boom 10. The connecting member 50 is a device configured to connect a hydraulic equipment attached to the auxiliary attachment to a piping member such as a pipe disposed on the left boom 10. The connecting member 50 is constituted of a hydraulic coupler 50*a*, and a support member (attachment stay) 50*b* for supporting the hydraulic coupler 50*a* on one of the booms 10.

The bucket cylinders 15 are arranged close to the front portions of the respective booms 10. The bucket cylinders 15 are extended and contracted to swing the bucket 11.

The pair of traveling devices 5 are hydraulically-driven devices, and are configured to be driven by traveling motors M1 constituted of hydraulic motors. One of the pair of the traveling devices 5 is disposed on the left portion of the machine body 2, and the other one of the pair of the traveling devices 5 is disposed on the right portion of the machine body 2. A crawler type (including semi-crawler type) traveling device is adopted to each of the pair of the traveling devices 5. A wheel-type traveling device having front wheels and rear wheels may also be adopted.

The prime mover 6 is an internal combustion engine such as a diesel engine or a gasoline engine, an electric motor, or the like. In the present embodiment, the prime mover 6 is the diesel engine, but is not limited thereto. Hereafter, the prime mover 6 is referred to as an engine.

Figure 1:
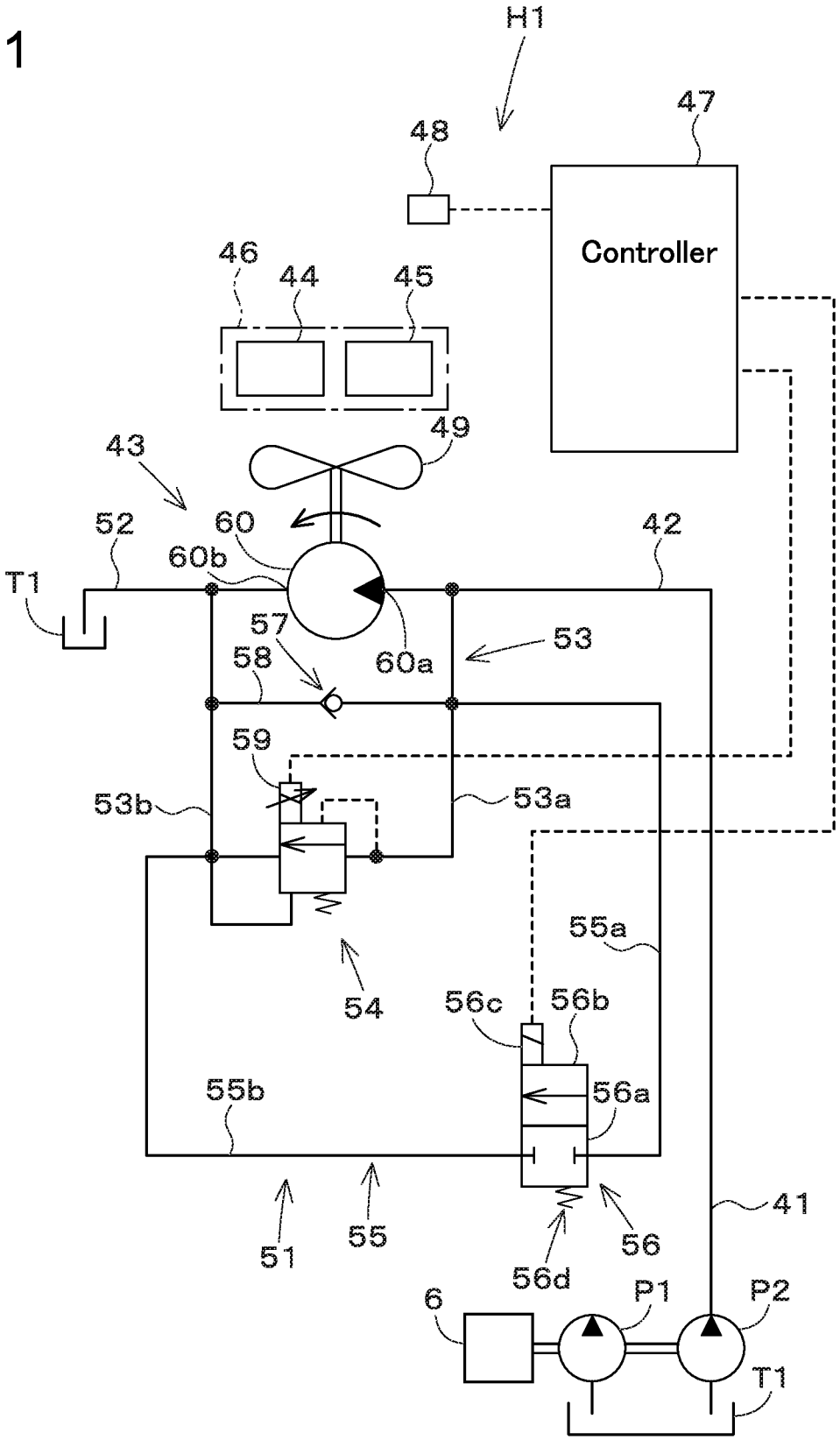
FIG. 1 is a circuit diagram of a hydraulic control system for a working machine according to a first embodiment.

FIG. 1 shows a hydraulic control system H1 of the working machine 1.

As shown in FIG. 1, the hydraulic control system H1 includes a first pump P1 (first hydraulic pump) and a second pump P2 (second hydraulic pump). The first pump P1 and the second pump P2 are constant displacement gear pumps configured to be driven by a power of the engine 6, and are hydraulic pumps configured to suck and deliver hydraulic fluid stored in the tank T1. The first pump P1 is a hydraulic pump configured to deliver the hydraulic fluid that drives the hydraulic actuators. The hydraulic actuators to be driven by the hydraulic fluid delivered from the first pump P1 are, for example, the boom cylinder 14 and the bucket cylinder 15 of the working device 4, the traveling motors M1 of the traveling devices 5, and the hydraulic actuator disposed on the attachment that is mounted in place of the bucket 11. The hydraulic fluid delivered from the second pump P2 is used to supply the hydraulic fluid (pilot fluid) for signals or controls.

The hydraulic control system H1 includes a controller 47. The controller 47 is configured using a microcomputer with, for example, a CPU (Central Processing Unit) and an EEPROM (Electrically Erasable Programmable Read-Only Memory).

The controller 47 is connected to a measuring device 48 configured to measure one or both of temperatures of the hydraulic fluid and the cooling water circulating in the working machine 1. The controller 47 is capable of obtaining one or both of the temperatures of the hydraulic fluid and the cooling water.

As shown in FIG. 1, a delivery fluid passage 41, which is a fluid passage through which the hydraulic fluid delivered from the second pump P2 flows, is connected to a delivery port of the second pump P2. A supply line 42, which is a fluid passage through which the hydraulic fluid delivered from the second pump P2 flows, is connected to a downstream portion of the delivery fluid passage 41. A cooling device 43 is disposed downstream of the supply line 42.

The cooling device 43 is a device for cooling cooled objects 46 such as an oil cooler 44 that cools the hydraulic fluid and a radiator 45 that cools the cooling water of the engine 6, and is driven by the hydraulic fluid delivered from the second pump P2.

The cooling device 43 includes a fan (cooling fan) 49 that rotates to generate a cooling air, a fan motor 60 that is driven by the hydraulic fluid to rotate the fan 49, and a bypass circuit 51 that makes the hydraulic fluid to be supplied to the fan motor 60 by bypassing the fan motor 60 and be discharged toward the tank T1.

The fan motor 60 is constituted of a hydraulic motor and is driven by the hydraulic fluid delivered from the second pump P2. In detail, as shown in FIG. 1, the fan motor 60 includes a first port 60*a* and a second port 60*b*. In the present embodiment, the first port 60*a* is a port on a hydraulic fluid inflow side where the hydraulic fluid flows into the fan motor 60. The second port 60*b* is a port on a hydraulic fluid outflow side where the hydraulic fluid flows out from the fan motor 60. The supply line 42 is connected to the first port 60*a*. A drain line 52 is connected to the second port 60*b*. The drain line 52 is a fluid passage through which the hydraulic fluid flowing out from the fan motor 60 flows. The hydraulic fluid flowing in the drain line 52 flows toward the tank T1 and returns to the tank T1.

The hydraulic fluid delivered from the second pump P2 flows into the fan motor 60 through the delivery fluid passage 41, the supply line 42, and the first port 60*a*, and the hydraulic fluid flowing into the fan motor 60 passes through the fan motor 60 and is discharged to the drain line 52 via the second port 60*b*. That is, the fan motor 60 is driven by the hydraulic fluid flowing from the first port 60*a* and vicinity thereof (one side) to the second port 60*b* and vicinity thereof (the other side). When the fan motor 60 is driven, the fan 49 rotates.

As shown in FIG. 1, the bypass circuit 51 includes a bypass fluid passage 53, a flow rate control valve 54 disposed on the bypass fluid passage 53, a drain passage 55 connected to the bypass fluid passage 53, and an unloading valve 56 disposed on the drain passage 55.

The bypass fluid passage 53 makes the hydraulic fluid to be supplied to the fan motor 60 by bypassing the fan motor 60 and be discharged toward the tank T1. In detail, the bypass fluid passage 53 is constituted of a first section (referred to as a first connection line) 53*a* connecting the supply line 42 (the first port 60*a* and vicinity thereof) to the flow rate control valve 54, and a second section (referred to as a second connection line) 53*b* connecting the drain line 52 (the second port 60*b* and vicinity thereof) to the flow rate control valve 54. The first connection line 53*a* and the second connection line 53*b* are connected by a connecting fluid passage 58 on which a check valve 57 is provided to prevent the hydraulic fluid from flowing from the first connection line 53*a* to the second connection line 53*b*.

The flow rate control valve 54 regulates a flow rate of the hydraulic fluid flowing in the bypass fluid passage 53. In other words, the flow rate control valve 54 regulates a flow rate of the hydraulic fluid to be supplied to the fan motor 60. Strictly speaking, the flow rate control valve 54 is a valve that defines a hydraulic fluid pressure that is delivered from the second pump P2 and supplied to the fan motor 60, and the flow rate control valve 54 controls (regulates) the hydraulic fluid pressure to be supplied to the fan motor 60, resulting in regulating the hydraulic fluid flow rate in the bypass fluid passage 53.

The flow rate control valve 54 is constituted of a solenoid valve. In detail, the flow rate control valve 54 is constituted of a solenoid proportional valve (variable relief valve) having a variable solenoid 59. The variable solenoid 59 (flow rate control valve 54) is connected to the controller 47. The controller 47 is capable of outputting a control signal to the flow rate control valve 54 to control the flow rate control valve 54. In detail, the controller 47 can regulate an electric current (current value) applied to the variable solenoid 59 to regulate an opening degree of the flow rate control valve 54 (degree of opening of a valve). A flow rate of the hydraulic fluid to be supplied to the fan motor 60 is regulated by regulating the opening degree of the flow rate control valve 54.

In other words, a pressure difference between the first port 60*a* and the second port 60*b* (pressure on an hydraulic fluid supply side of the fan motor 60) is set by the flow rate control valve 54, and the excess fluid generated by the hydraulic fluid from the second pump P2 exceeding the above-mentioned set pressure flows through the first connection line 53*a*, the flow rate control valve 54, and the second connection line 53*b* in the order to bypass the fan motor 60, thereby controlling a flow rate of the hydraulic fluid to be supplied to the fan motor 60.

The drain passage 55 is connected to the bypass fluid passage 53 and drains the hydraulic fluid. In detail, the drain passage 55 is connected to the bypass fluid passage 53 upstream of the flow rate control valve 54 and drains the hydraulic fluid existing upstream of the flow rate control valve 54. In other words, the drain passage 55 is a fluid passage connecting the first connection line 53*a* and the second connection line 53*b* to each other, and feeds the hydraulic fluid to be supplied to the fan motor 60 toward the tank T1 bypassing the flow rate control valve 54 and the fan motor 60. Moreover, in detail, the drain passage 55 includes a first section (referred to as third connection line) 55*a* connecting the first connection line 53*a* to the unloading valve 56, and a second section (referred to as fourth connection line) 55*b* connecting the second connection line 53*b* to the unloading valve 56.

The unloading valve 56 is a valve for opening and closing the drain passage 55, and is constituted of a solenoid valve. In detail, the unloading valve 56 is constituted of a solenoid opening/closing valve with a solenoid and is disposed in parallel with the flow rate control valve 54. The solenoid (of the unloading valve 56) is connected to the controller 47. The controller 47 is capable of outputting a control signal to the unloading valve 56 to control the unloading valve 56. In detail, the unloading valve 56 is a valve configured to be shifted between two positions: a full-closing position (OFF position) 56*a* and a full-opening position (ON position) 56*b*, and is held at the full-closing position 56*a* by a biasing force of a spring 56*d*. And, the unloading valve 56 is shifted to the full-opening position 56*b* when a magnetic force generated by an electric current applied to the solenoid 56*c* overcomes the biasing force of the spring 56*d*. The full-closing position 56*a* is a position to close the drain passage 55, and the full-opening position 56*b* is a position to open the drain passage 55.

In the cooling device 43 of the above-mentioned configuration, when the flow rate control valve 54 is fully closed and the unloading valve 56 is shifted to the full-closing position 56*a*, most of the hydraulic fluid flowing into the first port 60*a* flows into the fan motor 60. In this manner, a fan rotation speed, which is a rotation speed of the fan 49, reaches the maximum rotation speed. In addition, when the unloading valve 56 is shifted to the full-opening position 56*b*, the hydraulic fluid flowing to the first port 60*a* of the fan motor 60 (hydraulic fluid flowing in the supply line 42) bypasses the fan motor 60 and the flow rate control valve 54, and then flows through the first connection line 53*a*, the third connection line 55*a*, the fourth connection line 55*b*, the second connection line 53*b*, and the drain line 52 in the order, so that the fan rotation speed becomes the minimum rotation speed (including zero speed).

In the present embodiment, when the flow rate control valve 54 is fully closed and the unloading valve 56 is fully opened, a flow rate of the hydraulic fluid passing through the unloading valve 56 becomes higher than a flow rate of the hydraulic fluid passing through the flow rate control valve 54 when the unloading valve 56 is fully closed and the flow rate control valve 54 is fully opened. In addition, in a case where a fan rotation speed is set to the minimum rotation speed, both the unloading valve 56 and the flow rate control valve 54 may be opened.

In addition, when the unloading valve 56 is set to the full-closing position 56*a* and an opening degree of the flow rate control valve 54 is set to regulate a flow rate of the hydraulic fluid supplied to the fan motor 60, the fan rotation speed can be changed.

Conventionally, the fan motor 60 is controlled only by the flow rate control valve 54, so there is a case where the fan cannot be stopped just by fully opening the flow rate control valve 54. For example, when a rotation speed of the engine 6 is high and a flow rate of the hydraulic fluid supplied to the fan motor 60 is high, an override characteristic of the flow rate control valve 54 may cause the fan 49 to rotate even when the control tries to reduce the fan rotation speed.

In the present embodiment, since the unloading valve 56 is mounted in parallel with the flow rate control valve 54, the minimum rotation speed can be reduced more than the conventional minimum rotation speed, or the fan 49 can also be stopped.

When the unloading valve 56 is shifted from the full-opening position 56*b* to the full-closing position 56*a* under a state where the flow rate control valve 54 is fully closed and the unloading valve 56 is in the full-opening position 56*b*, a surge pressure may be generated in the fan motor 60 and the second pump P2 due to a sudden fluctuation of pressure caused by a sudden interruption of the flowing hydraulic fluid. Accordingly, when the unloading valve 56 is shifted from the full-opening position 56*b* to the full-closing position 56*a* to increase a fan rotation speed of the fan 49 from the minimum rotation speed including the stopping, it is necessary to prevent a surge pressure from being generated in the fan motor 60 and the second pump P2.

To prevent a surge pressure from being generated in increasing a fan rotation speed of the fan 49 from the minimum rotation speed, the flow rate control valve 54 is opened to a predetermined opening degree in shifting the unloading valve 56 from the full-opening position 56*b* to the full-closing position 56*a*. In other words, the unloading valve 56 is shifted from the full-opening position 56*b* to the full-closing position 56*a* under a state where the flow rate control valve 54 is opened at the predetermined opening degree. In this manner, the sudden interruption of the flowing hydraulic fluid can be suppressed, and a surge pressure can be prevented from being generated in the fan motor 60 and the second pump P2.

To explain the above operations in more detail, in the present embodiment, an electric current is applied to the flow rate control valve 54 in shifting the unloading valve 56 from the full-opening position 56*b* to the full-closing position 56*a*, and thus the flow rate control valve 54 is opened to the predetermined opening degree. After shifting the unloading valve 56 to the full-closing position 56*a*, the electric current applied to the flow rate control valve 54 is decreased after a predetermined period has elapsed to close the flow rate control valve 54. At this time, the electric current applied to the flow rate control valve 54 is not decreased instantaneously but gradually. That is, after shifting the unloading valve 56 to the full-closing position 56*a*, the flow rate control valve 54 is gradually closed further after the predetermined period has elapsed. In this manner, the surge pressure generated by instantaneously lowering the electric current applied to the flow rate control valve 54 (instantaneously closing the flow rate control valve 54) can be suppressed by gradually reducing the electric current (gradually closing the flow rate control valve 54). In addition, during a period when the unloading valve 56 is being shifted from the full-opening position 56*b* to the full-closing position 56*a*, the electric current value applied to the flow rate control valve 54 is kept constant.

In addition, the control for shifting the unloading valve 56 from the full-opening position 56*b* to the full-closing position 56*a* may be performed as follows.

That is, in shifting the unload valve 56 from the full-opening position 56*b* to the full-closing position 56*a*, the flow rate control valve 54 is opened to the predetermined opening degree under a state where the unload valve 56 is in the full-opening position 56*b*, and the unload valve 56 is shifted to the full-closing position 56*a* during a period when the flow rate control valve 54 is gradually closed. In other words, the unloading valve 56 is shifted from the full-opening position 56*b* to the full-closing position 56*a* during a period when the flow rate control valve 54 is gradually closed from a state of being opened at the predetermined opening degree. Specifically, under a state where the unloading valve 56 in the full-opening position 56*b*, an electric current is applied to the flow rate control valve 54, and then the electric current is slowly decreased. Then, the unloading valve 56 is shifted to the full-closing position 56*a* during a period when the electric current is being reduced. The electric current value at the timing when the unloading valve 56 is shifted to the full-closing position 56*a* is a constant value except 0 mA. That is, the electric current value at the timing when the unload valve 56 is shifted to the full-closing position 56*a* may be an electric current value at which the spring 56*d* overcomes a magnetic force of the solenoid 56*c*.

It is preferred that the electric current value applied to the flow rate control valve 54 when the unloading valve 56 is shifted to the full-closing position 56*a* is increased to the maximum value in a control range of the electric current value. However, it is not necessary to increase an electric current value to a region in which a pressure output from the flow rate control valve 54 cannot be changed (changing range becomes small) despite of increasing in the electric current value.

In addition, when the unloading valve 56 is held in the full-opening position 56*b* and the electric current supply is shut down because of breaking of an electric wire connected to the unloading valve 56, for example, the unloading valve 56 will be shifted from the full-opening position 56*b* to the full-closing position 56*a*. In preparation for this case, the flow rate control valve 54 may be opened at a predetermined opening degree in shifting the unloading valve 56 to the full-opening position 56*b* and holding the unloading valve 56 at the full-opening position 56*b*. In detail, in a mode where the unloading valve 56 is held in the full-opening position 56*b*, that is, when either or both the temperatures of the hydraulic fluid and cooling water are below a certain level, an electric current value not less than a certain level is applied to the flow rate control valve 54. In this case, an electric current value less than the maximum value in the control range is applied to the flow rate control valve 54. This allows the electric current consumption to be reduced. To rephrase the above-mentioned control, the controller 47 sets the flow rate control valve 54 to a predetermined opening degree by outputting a second control signal to the flow rate control valve 54 under a state where the first control signal is output to the unloading valve 56 to hold the unloading valve 56 in the full-opening position 56*b*.

In the above-mentioned embodiment, the flow rate control valve 54 and the unloading valve 56 are constituted of a solenoid valve to be controlled by an electric current. However, the configuration is not limited to this, and one or both of the flow rate control valve 54 and the unloading valve 56 may be a pilot-operated switching valve capable of changing an opening degree thereof with a pilot pressure (a pressure of the pilot fluid). Alternatively, they may be a solenoid-piloted switching valve.

In addition, the third connection line 55*a* may be configured to connect the supply line 42 to the unloading valve 56, and the fourth connection line 55*b* may be configured to connect the drain line 52 to the unloading valve 56.

Moreover, the fan motor 60 is exemplified by the motor that rotates with the hydraulic fluid flowing from the first port 60*a* to the second port 60*b*. However, the fan motor 60 may be a normally/reversely rotatable fan motor 60 that rotates normally with the hydraulic fluid flowing in one direction and rotates reversely with the hydraulic fluid flowing in the other direction. In this case, a directional control valve is disposed in the cooling device 43, the directional control valve being configured to switch a flow direction of the hydraulic fluid flowing through the fan motor 60.

Figure 2:
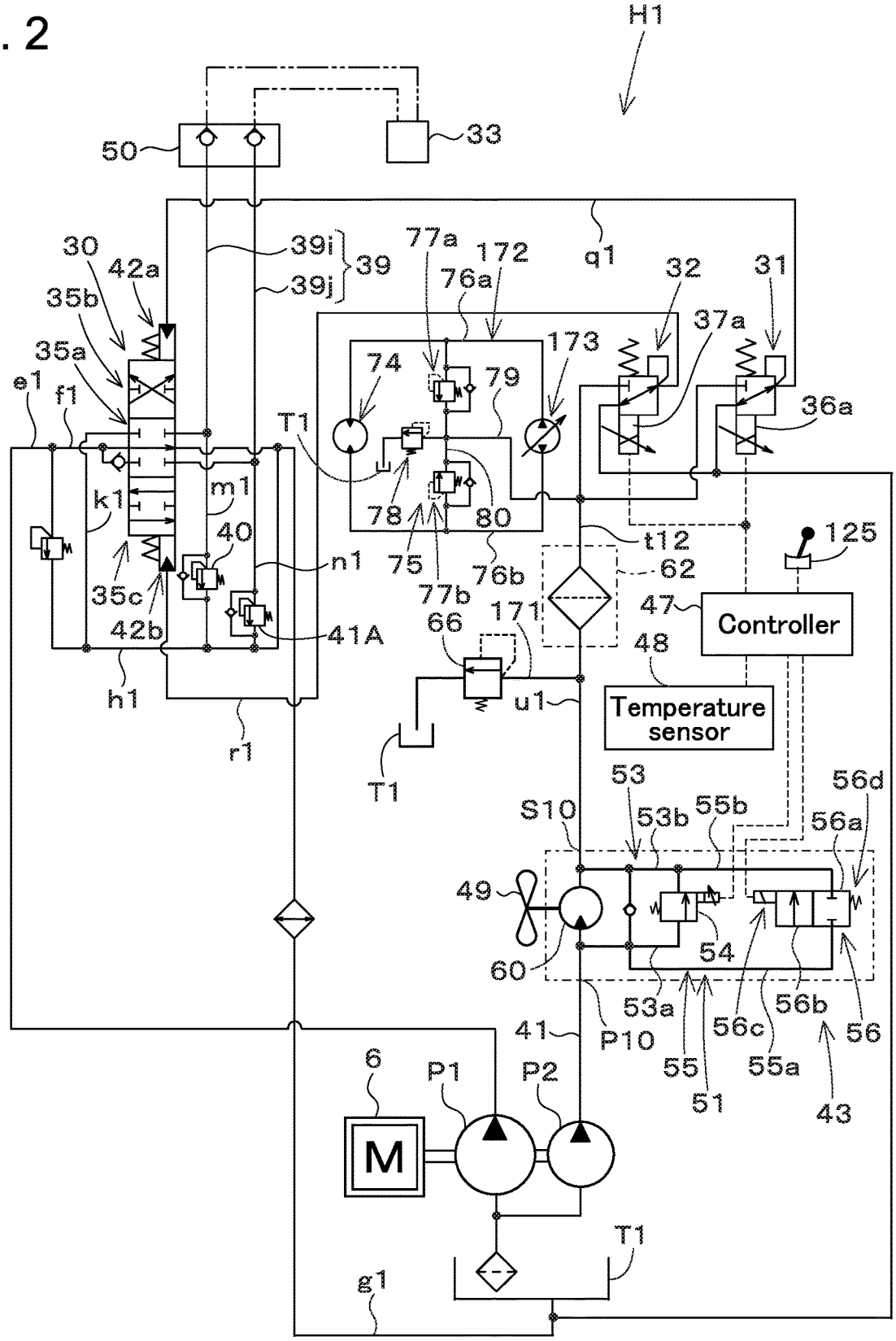
FIG. 2 is a circuit diagram showing a hydraulic control system according to another embodiment.

FIG. 2 shows the hydraulic control system H1 according to another embodiment.

The hydraulic control system H1 according to the embodiment shown in FIG. 2 includes an auxiliary control valve (referred to as a SP control valve) 30 and auxiliary solenoid valves (referred to as SP solenoid valves) 31 and 32. The SP solenoid valves 31 and 32 are a pair of solenoid valves that operate the SP control valve 30.

The first pump P1 is used to drive a hydraulic actuator 33 of the auxiliary attachment to be attached in place of the bucket 11. For convenience of explanation, the hydraulic actuator 33 of the auxiliary attachment is referred to as an auxiliary actuator. An operation member 125 for operating the auxiliary actuator 33 is connected to the controller 47.

The SP control valve 30 is a pilot-operated three-position switching valve with a direct-acting spool. The SP control valve 30 is shiftable among a neutral position 35*a*, a first position 35*b*, and a second position 35*c* with the pilot pressure. The SP control valve 30 is returned to the neutral position 35*a* by a spring.

The SP control valve 30 is connected to a working system supply fluid passage f1 which is connected to a delivery passage e1 of the first pump P1. In addition, a bypass fluid passage h1 is connected to the SP control valve 30 via a drain fluid passage k1, and is also connected to a drain fluid passage g1 returning toward the tank T1.

In addition, a hydraulic fluid supply passage 39 is connected to and between the SP control valve 30 and the connecting member 50. The hydraulic fluid supply passage 39 is constituted of two flow passages: a flow passage 39*i* and a flow passage 39*j*. The flow passage 39*i* is connected to the bypass fluid passage h1 via a first relief passage m1, and the flow passage 39*j* is connected to the bypass fluid passage h1 via a second relief passage n1. Relief valves 40 and 41A are disposed in the first and second relief passages m1 and n1, respectively.

The connection member 50 connects the SP control valve 30 to the auxiliary actuator 33, and connects the SP control valve 30 to the auxiliary actuator 33 via the hydraulic fluid supply passage 39, hydraulic hoses and the like.

The SP solenoid valve 31 is connected to a pressure receiving portion 42*a* (on one side) of the SP control valve 30 via a first pilot fluid passage q1. The SP solenoid valve 32 is connected to a pressure receiving portion 42*b* (on the other side) of the SP control valve 30 via a second pilot fluid passage r1. The pilot fluid (pressured fluid) from the second pump P2 can be supplied to the SP solenoid valves 31 and 32 via a pilot pressure supply passage t12. Accordingly, when the SP control valve 30 is shifted to the first position 35*b* by the SP solenoid valve 31, the hydraulic fluid from the first pump P1 is supplied from the flow passage 39*i* to the auxiliary actuator 33, and the fluid returned from the auxiliary actuator 33 flows from the flow passage 39*j* to the drain fluid passage k1.

In addition, when the SP control valve 30 is shifted to the second position 35*c* by the SP solenoid valve 32, the hydraulic fluid from the first pump P1 is supplied from the flow passage 39*j* to the auxiliary actuator 33, and the return fluid from the auxiliary actuator 33 flows from the flow passage 39*i* to the drain fluid passage k1.

In the hydraulic control system H1 described above, the auxiliary actuator 33 of the auxiliary attachment can be actuated via the SP control valve 30 by actuating the SP solenoid valves 31 and 32.

The SP solenoid valves 31 and 32 are controlled by the controller 47 mounted on the working machine 1. The controller 47 executes operations of the SP solenoid valves 31 and 32 (SP control valves 30) according to an operation of a switch or the like disposed on the operation member 125.

In the above-mentioned hydraulic control system H1, the fan motor 60 is disposed between the second pump P2 and the pilot pressure supply passage t12 that supplies the pilot fluid (pressured fluid) to the SP solenoid valves 31 and 32. The fan motor 60 is disposed downstream of the second pump P2 in a flow of hydraulic fluid delivered from the second pump P2. A port P10, which is a primary side of the fan motor 60 and is an inlet of the hydraulic fluid, is connected to the second pump P2 by the delivery fluid passage 41, and the hydraulic fluid is supplied from the second pump P2 to the fan motor 60. In addition, a port S10, which is a secondary side of the fan motor 60 and is an output port of the hydraulic fluid, is connected to a fluid passage u1, and a filter 62, which filtrates the hydraulic fluid, is connected to the fluid passage u1. The fluid passage u1 is connected to a portion upstream of the filter 62, and the pilot pressure supply fluid passage t12 is connected a portion downstream of the filter 62. Accordingly, the hydraulic fluid that flows through the fan motor 60 and is output from the port S10 on the secondary side is filtrated by the filter 62 and supplied to the pilot pressure supply fluid passage t12.

The bypass fluid passage 53 connects a portion slightly downstream of the port P10 on the primary side of the fan motor 60 to a portion slightly upstream of the port S10 on the secondary side of the fan motor 60. The flow rate control valve 54 is disposed on the bypass fluid passage 53. The controller 47 executes an operation of the flow rate control valve 54 to rotate the fan 49 at an appropriate rotation speed according to one or both of the fluid temperature and water temperature detected by the measuring device (temperature sensor) 48, thereby changing an amount of hydraulic fluid to be supplied to the primary side of the fan motor 60. The controller 47 and the measurement device 48 may be integrated in one body.

In the hydraulic control system H1 shown in FIG. 2, the cooling device 43 includes the above-mentioned drain passage 55 and unloading valve 56.

Moreover, in the hydraulic control system H1 shown in FIG. 2, a relief fluid passage 171 is connected to the fluid passage u1 between the secondary side of the fan motor 60 and the filter 62. A relief valve 66 is disposed in the relief fluid passage 171, the relief valve 66 being configured to set the maximum pressure (relief pressure) of the hydraulic fluid flowing in the fluid passage u1. Accordingly, when the hydraulic fluid flowing in the fluid passage u1 between the fan motor 60 and the filter 62 becomes high pressure not less than a relief pressure, the hydraulic fluid output from the fan motor 60 can be released to the tank T1. This allows the filter 62 to be protected.

The hydraulic control system H1 includes an HST (Hydro-Static Transmission: hydrostatic continuously variable transmission) 172. The HST 172 includes an HST pump 173 to be driven by the engine 6, and an HST motor 74 connected to the HST pump 173 by a pair of speed-shifting fluid passages 76*a* and 76*b* to form a closed circuit. The HST motor 74 constitutes the traveling motor M1.

The HST 172 includes a charging circuit 75 that charges the hydraulic fluid to a lower-pressurized one of the speed-shifting fluid passages 76*a* and 76*b*. The charging circuit 75 includes high pressure relief valves 77*a* and 77*b* that release a pressure of a higher-pressurized one of the speed-shifting fluid passages 76*a* and 76*b* to the other lower-pressurized one of the shifting fluid passages 76*a* and 76*b* when the pressure of the higher-pressurized one of the speed-shifting fluid passages 76*a* and 76*b* becomes a predetermined pressure or higher. The fluid passage 80 is connected to the pilot pressure supply fluid passage t12 via a charging fluid passage 79. Accordingly, the hydraulic fluid delivered from the second pump P2 to flow through the fan motor 60 and filter 62 flows to the charging circuit 75 through the charging fluid passage 79. In addition, the charging circuit 75 includes a charging relief valve 78 configured to set a circuit pressure of the charging circuit 75, and the charging relief valve 78 is connected to the charging fluid passage 79 and the tank T1.

In the hydraulic control system H1 of the above-mentioned configuration according to the other embodiment, the fan motor 60, the relief valve 66, the filter 62, the HST 172, and the flow rate control valve 54 are arranged in parallel.

Next, referring to FIGS. 4 to 8, the working machine 1 according to of a second embodiment will be described.

Figure 8:
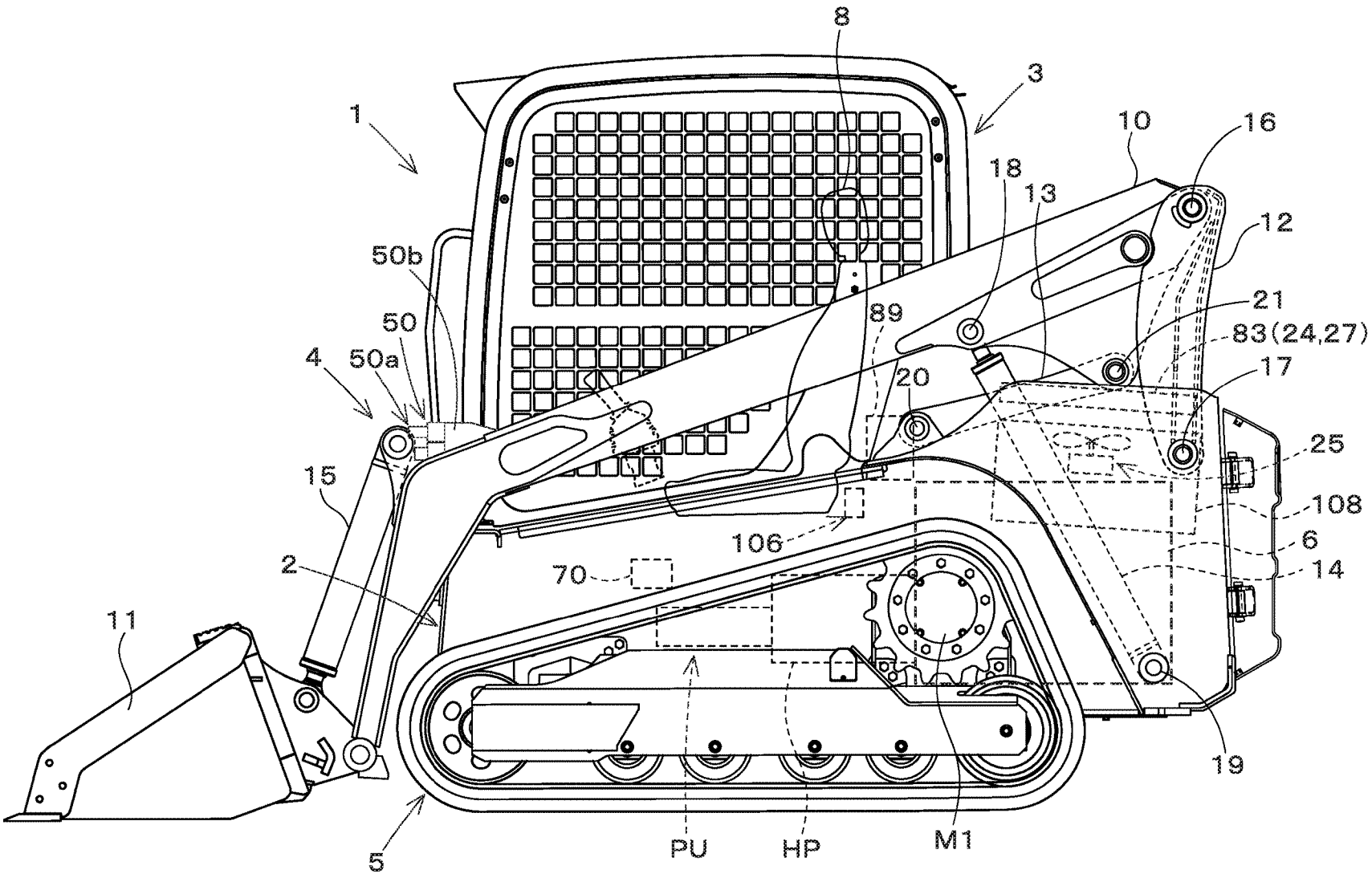
FIG. 8 is a side view of the working machine according to the second embodiment.

FIG. 8 shows a side view of the working machine 1 according to the second embodiment. In the second embodiment, the compact track loader is shown as an example of the working machine 1. As shown in FIG. 8, in the second embodiment, the working machine 1 includes the machine body 2 having the rear portion on which the prime mover 6 is mounted, the cabin 3 being mounted on the machine body 2 and having an interior in which the operator's seat 8 is disposed, the working device 4 attached to the machine body 2, and the pair of traveling devices 5 disposed on the outside of the machine body 2. Since the basic configurations of the working machine 1 (the configuration of the working device 4, traveling devices 5, and the like) are the same as those according to the above-mentioned first embodiment, the descriptions thereof are omitted with the similar reference numerals.

Figure 4:
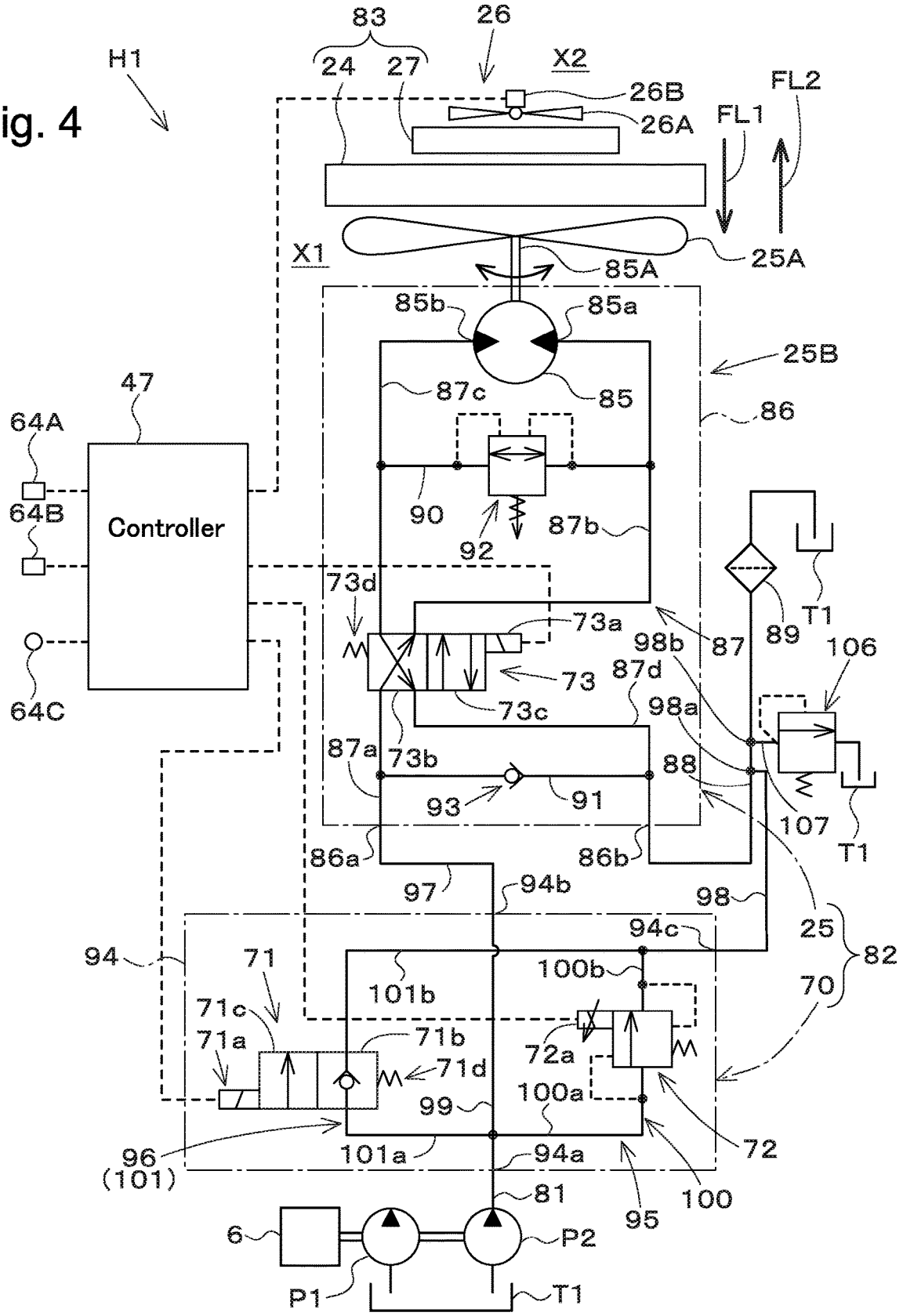
FIG. 4 is a circuit diagram of a hydraulic control system for a working machine according to a second embodiment.

FIG. 4 shows the hydraulic control system H1 installed in the working machine 1.

As shown in FIG. 4, the hydraulic control system H1 includes the first pump P1 (first hydraulic pump) and the second pump P2 (second hydraulic pump). The first pump P1 and the second pump P2 are constant displacement gear pumps configured to be driven by a power of the engine 6, and are hydraulic pumps configured to suck and deliver hydraulic fluid stored in the tank T1. The first pump P1 is a hydraulic pump configured to deliver the hydraulic fluid that drives the hydraulic actuator. The hydraulic actuators to be driven by the hydraulic fluid delivered from the first pump P1 are, for example, the boom cylinder 14 and the bucket cylinder 15 of the working device 4, the traveling motors M1 of the traveling devices 5, and the hydraulic actuator disposed on the attachment mounted in place of the bucket 11. The hydraulic fluid delivered from the second pump P2 is used to supply the hydraulic fluid (pilot fluid) for signals or controls.

As shown in FIG. 8, a pump unit PU including the first pump P1 and the second pump P2 is installed in front of the engine 6. In detail, as shown in FIG. 8, an HST pump HP is mounted in front of the engine 6, and the pump unit PU is mounted in front of the HST pump HP. The HST pump HP constitutes a part of the HST (Hydro-Static Transmission: hydrostatic continuously variable transmission) and is driven by a power of the engine 6. The HST pump HP is connected to the traveling motor M1 by the pair of transmission fluid passages to form a closed circuit. The HST motor HP is driven to rotate the traveling motor M1.

As shown in FIG. 4, the hydraulic control system H1 includes the controller 47. The controller 47 is configured using a microcomputer with, for example, a CPU (Central Processing Unit) and an EEPROM (Electrically Erasable Programmable Read-Only Memory).

As shown in FIG. 4, a delivery fluid passage 81, which is a fluid passage through which the hydraulic fluid delivered from the second pump P2 flows, is connected to the delivery port of the second pump P2. A cooling device 82 is disposed downstream of the delivery fluid passage 81. The cooling device 82 is a device for cooling cooled objects 83. The cooled objects 83, for example, include a radiator 24 configured to cool the cooling water for cooling the engine 6, a condenser 27 to condense refrigerant of an air conditioner, and an oil cooler, not shown in the drawings, configured to cool the hydraulic fluid to activate the hydraulic devices.

The cooling device 82 includes a fan device (referred to as a first fan device) 25 configured to cool the cooled objects 83, and a fan rotation controller 70 configured to control rotation of the first fan device 25.

As shown in FIG. 4, the first fan device 25 is a hydraulic fan to be driven by hydraulic fluid (hydraulic pressure) delivered from the second pump P2. The first fan device 25 is disposed on one directional surface side X1 of the cooled objects 83 (one directional surface side X1 of the radiator 24). The condenser 27 is disposed on the other directional surface side X2 of the radiator 24 (opposite to a side on which the first fan device 25 is disposed).

The first fan device 25 includes a fan (referred to as first fan) 25A and a fan driving device 25B having a fan motor 85 for driving the first fan 25A.

The first fan 25A includes a plurality of blades radially disposed on an outer circumference of a center boss and rotates to generate air flow. The first fan 25A is disposed on the one directional surface side X1 of the cooled objects 83 (radiator 24). The first fan 25A is connected to an output shaft 85A of the fan motor 85 and rotates with the fan motor 85 being driven to normally rotate. By normally rotating the fan motor 85, the first fan 25A rotates in a first direction so as to generate a first air flow (cooling wind) FL1 flowing in a direction from the other directional surface side X2 of the cooled objects 83 toward the one directional surface side X1.

By reversely rotating the fan motor 85, the first fan 25A rotates in a second direction, which is a direction opposite to the first direction, so as to generate a second air flow FL2 flowing in a direction from the one directional surface side X1 of the cooled objects 83 toward the other directional surface side X2. The first direction and the second direction are rotation directions around the output shaft 85A of the fan motor 85, and the first direction is opposite to the second direction.

In the present embodiment, the first air flow FL1 is an air flow flowing in a direction of taking outside air into the machine body 2, and the second air flow FL2 is an air flow flowing in a direction of discharging air inside the machine body 2 to the outside. The first air flow FL1 cools the cooled objects 83. The second air flow FL2 blows dusts adhering to the cooled targets 83 (radiator 24, condenser 27, oil cooler). An air volume of the first fan 25A becomes larger when the first fan 25A is rotated in the first direction (normally rotated) than the air volume generated when the first fan 25A is rotated in the second direction (reversely rotated). That is, an air volume of the first air flow FL1 is larger than that of the second air flow FL2.

As shown in FIG. 4, the fan driving device 25B includes the fan motor 85, a directional control valve 73, and a motor housing 86.

The fan motor 85 is a motor that is driven to rotate the first fan 25A, and is constituted of a hydraulic motor to be driven by the hydraulic fluid from the second pump P2. In detail, the fan motor 85 includes a first motor port 85*a* and a second motor port 85*b*, and the hydraulic fluid flows into the fan motor 85 from one of the first motor port 85*a* and the second motor port 85*b* and flows out from the other, that is, the hydraulic fluid flows through the fan motor 85, and the fan motor 85 is driven to rotate. The fan motor 85 can be rotated reversely and normally by switching a flow direction of the hydraulic fluid that drives the fan motor 85. The output shaft 85A of the fan motor 85 protrudes outward from the motor housing 86.

The directional control valve 73 is a valve that switches a rotation direction of the fan motor 85 between normal and reverse directions, and switches a direction of the hydraulic fluid driving the fan motor 85 to switch the rotation direction of the first fan 25A. In detail, the directional control valve 73 is constituted of a solenoid switching valve having a solenoid 73*a*, and the solenoid 73*a* (directional control valve 73) is connected to a controller 470. That is, the controller 47 outputs a control signal to the directional control valve 73 to control the directional control valve 73. Specifically, the directional control valve 73 is a valve configured to be shifted between two positions: a first position (OFF position) 73*b* and a second position (ON position) 73*c*, and is held in the first position 73*b* by a biasing force of the spring 73*d*. Then, the directional control valve 73 is shifted to the second position 73*c* with a magnetic force generated by an electric current applied to the solenoid 73*a* when the magnetic force overcomes the biasing force of the spring 73*d*. When the directional control valve 73 is in the first position 73*b*, the hydraulic fluid flows from the first motor port 85*a* to the second motor port 85*b*, and then the fan motor 85, for example, rotates normally. In addition, when the directional control valve 73 is shifted to the second position 73*c*, the hydraulic fluid flows from the second motor port 85*b* to the first motor port 85*a*, and then the fan motor 85, for example, rotates reversely.

The motor housing 86 is a casing that houses the fan motor 85 and the directional control valve 73. That is, the fan motor 85 and the directional control valve 73 are incorporated in the motor housing 86. The motor housing 86 is a block body in which fluid passages can be formed, and includes an introduction port (referred to as a first introduction port) 86*a*, a discharge port (referred to as a first discharge port) 86*b*, and a motor driving fluid passage 87.

The first introduction port 86*a* is a port into which the hydraulic fluid to be supplied to the fan motor 85 is introduced (flows). The first discharge port 86*b* is a port through which the hydraulic fluid having passed through the fan motor 85 is discharged from the motor housing 86.

The motor driving fluid passage 87 is a fluid passage that is connected to the first introduction port 86*a* and the first discharge port 86*b*, and supplies the hydraulic fluid from the first introduction port 86*a* to the first discharge port 86*b* through the fan motor 85. That is, the motor driving fluid passage 87 is a fluid passage through which the hydraulic fluid for driving the fan motor 85 flows. The motor driving fluid passage 87 is formed, for example, as a hole made by drilling the motor housing 86. The motor driving fluid passage 87 includes a first fluid passage 87*a*, a second fluid passage 87*b*, a third fluid passage 87*c*, and a fourth fluid passage 87*d*. The fan motor 85 and the directional control valve 73 are disposed in the motor driving fluid passage 87.

The first fluid passage 87*a* connects the first introduction port 86*a* to the directional control valve 73. The second fluid passage 87*b* connects the directional control valve 73 to the first motor port 85*a*. The third fluid passage 87*c* connects the second motor port 85*b* to the directional control valve 73. The fourth fluid passage 87*d* connects the directional control valve 73 to the first discharge port 86*b*.

In the first fan device 25, when the directional control valve 73 is in the first position 73*b*, the hydraulic fluid having flown from the first introduction port 86*a* into the first fan device 25 flows through the first fluid passage 87*a*, the directional control valve 73, the second fluid passage 87*b*, the fan motor 85, the third fluid passage 87*c*, the directional control valve 73, and the fourth fluid passage 87*d* in the order, and then is discharged from the first discharge port 86*b*. In addition, when the directional control valve 73 is in the second position 73*c*, the hydraulic fluid having flowed from the first introduction port 86*a* into the first fan device 25 flows through the first fluid passage 87*a*, the directional control valve 73, the third fluid passage 87*c*, the fan motor 85, the second fluid passage 87*b*, the directional control valve 73, and the fourth fluid passage 87*d* in the order, and then is discharged from the first discharge port 86*b*.

The first discharge port 86*b* is connected to a discharge flow passage 88 that is a fluid passage through which the hydraulic fluid discharged from the first discharge port 86*b* flows. The discharge flow passage 88 is a fluid passage disposed outside the motor housing 86. A hydraulic filter 89 is disposed on the discharge flow passage 88 downstream of the first discharge port 86*b*. The discharge flow passage 88 is connected to the tank T1, and the hydraulic fluid discharged from the first discharge port 86*b* returns to the tank T1.

A relief fluid passage 107 is connected to the discharge flow passage 88 upstream of the hydraulic filter 89. In the relief passage 107, a relief valve 106 is disposed to set the maximum pressure (relief pressure) of the hydraulic fluid flowing in the discharge flow passage 88. Accordingly, when a pressure of the hydraulic fluid flowing through the discharge flow passage 88 becomes equal to or higher than the relief pressure, the hydraulic fluid can be released to the tank T1 to protect the hydraulic filter 89.

In the motor housing 86, a first connecting fluid passage 90 connecting the second fluid passage 87*b* to the third fluid passage 87*c* and a second connecting fluid passage 91 connecting the first fluid passage 87*a* to the fourth fluid passage 87*d* are formed. An over-relief valve 92 is disposed in the first connecting fluid passage 90. When one of pressures in the second fluid passage 87*b* and the third fluid passage 87*c* becomes equal to or higher than a predetermined pressure, the over-relief valve 92 releases the pressure from a higher-pressurized portion to a lower-pressurized portion. The predetermined pressure of the over-relief valve 92 is adjustable. A check valve 93 is disposed on the second connecting fluid passage 91 to prevent the hydraulic fluid from flowing the first fluid passage 87*a* to the fourth fluid passage 87*d*.

As shown in FIG. 4, the fan rotation controller 70 includes a valve housing 94, a flow rate control valve 72, and an unloading valve 71. The fan rotation controller 70 is disposed at a position separated from the first fan device 25 (fan driving device 25B).

The valve housing 94 is a casing that houses the flow rate control valve 72 and the unloading valve 71. That is, the flow rate control valve 72 and the unloading valve 71 are incorporated in the valve housing 94. The valve housing 94 is a block body in which fluid passages can be formed, and includes an introduction port (referred to as a second introduction port) 94*a*, an output port 94*b*, a discharge port (referred to as a second discharge port) 94*c*, a first internal fluid passage 95, and a second internal fluid passage 96.

The second introduction port 94*a* is connected to the delivery fluid passage 81. Accordingly, the hydraulic fluid delivered from the second pump P2 is introduced into the second introduction port 94*a*. In other words, the hydraulic fluid delivered from the second pump P2 is supplied to the fan rotation controller 70 via the second introduction port 94*a*. The output port 94*b* is connected to the first introduction port 86*a* via an external fluid passage (first external fluid passage) 97 formed outside the valve housing 94 and motor housing 86. The second discharge port 94*c* is connected to the discharge flow passage 88 via an external fluid passage (second external fluid passage) 98.

A joint 98*b* to the relief fluid passage 107 is disposed downstream of a joint 98*a* between the discharge flow passage 88 and the second external fluid passage 98 and in the vicinity of the joint 98*a*. The joint 98*a* is disposed in the vicinity of the relief valve 106. The joint 98*a* needs only to be located between the first discharge port 86*b* and the joint 98*b* between the discharge flow passage 88 and the relief fluid passage 107. In addition, the second external fluid passage 98 may also be connected to the relief fluid passage 107. Moreover, the discharge flow passage 88, the second external fluid passage 98, and the relief fluid passage 107 may be merged at a single location.

The first internal fluid passage 95 and the second internal fluid passage 96 are formed in the valve housing 94. The first internal fluid passage 95 and the second internal fluid passage 96 are formed, for example, as holes made by drilling the valve housing 94.

The first internal fluid passage 95 is a fluid passage that connects at least the second introduction port 94*a* to the output port 94*b*, and the flow rate control valve 72 is disposed in the first internal fluid passage 95. In detail, the first internal fluid passage 95 includes a pump fluid passage 99 connecting the second introduction port 94*a* to the output port 94*b*, and a bypass fluid passage 100 branched from the pump fluid passage 99 and connected to the second discharge port 94*c*. The flow rate control valve 72 is disposed on the bypass fluid passage 100.

The pump fluid passage 99 guides the hydraulic fluid flowing from the second introduction port 94*a* to supply the hydraulic fluid to the fan driving device 25B. In detail, the hydraulic fluid delivered from the second pump P2 is output from the valve housing 94 (fan rotation controller 70) through the second introduction port 94*a*, the pump fluid passage 99, and the output port 94*b* in the order, and is supplied from the first introduction port 86*a* to the motor housing 86 (fan driving device 25B) from the first introduction port 86*a* via the first external fluid passage 97.

The bypass fluid passage 100 includes a first section 100*a*, which is a fluid passage connecting the pump fluid passage 99 to the flow rate control valve 72, and a second section 100*b*, which is a fluid passage connected to the flow rate control valve 72 and to the second discharge port 94*c*. The bypass fluid passage 100 guides the hydraulic fluid flowing from the second inlet port 94*a* to discharge the hydraulic fluid from the second discharge port 94*c* via the flow rate control valve 72.

The second internal fluid passage 96 is a fluid passage that is connected to the first internal fluid passage 95 and includes an unloading fluid passage 101 that branches from the pump fluid passage 99 and is connected to the second discharge port 94*c*. In the present embodiment, the second internal fluid passage 96 is the unloading fluid passage 101. The unloading fluid passage 101 (second internal fluid passage 96) shares a connecting portion connected to the second discharge port 94*c* with the bypass fluid passage 100 (first internal fluid passage 95).

The unloading valve 71 is disposed in the unloading fluid passage 101. In detail, the unloading fluid passage 101 includes a first portion 101*a*, which is a fluid passage connecting the pump fluid passage 99 to the unloading valve 71, and a second portion 101*b*, which is a fluid passage connected to the unloading valve 71 and connected to (communicated with) the second discharge port 94*c*. The unloading fluid passage 101 guides the hydraulic fluid flowing from the second inlet port 94*a* to discharge the hydraulic fluid from the second discharge port 94*c* via the unloading valve 71.

The flow rate control valve 72 regulates a flow rate of the hydraulic fluid flowing in the bypass fluid passage 100. In other words, the flow rate control valve 72 regulates a flow rate of the hydraulic fluid to be supplied to the fan motor 85. Strictly speaking, the flow rate control valve 72 is a valve configured to define a pressure of the hydraulic fluid delivered from the second pump P2 and supplied to the fan motor 85, and by controlling (regulating) the pressure of the hydraulic fluid supplied to the fan motor 85, the flow rate control valve 72 thus regulates the flow rate of the hydraulic fluid flowing in the bypass fluid passage 100.

The flow rate control valve 72 is constituted of a solenoid valve. In detail, the flow rate control valve 72 is constituted of a solenoid proportional valve (variable relief valve) having a variable solenoid 72*a*. The variable solenoid 72*a* (flow rate control valve 72) is connected to the controller 47. The controller 47 outputs a control signal to the flow rate control valve 72 to control the flow rate control valve 72. In detail, the controller 47 can regulate an opening degree (degree of valve opening) of the flow rate control valve 72 by regulating an electric current (current value) applied to the variable solenoid 72*a*. The controller 47 regulate the flow rate of the hydraulic fluid to be supplied to the fan motor 85 by regulating the opening degree of the flow rate control valve 72.

In other words, the flow rate control valve 72 determines a pressure on the hydraulic fluid supply side of the fan motor 85, and the excess fluid generated when the hydraulic fluid from the second pump P2 exceeds the above predetermined pressure flows through the first section 100*a*, the flow rate control valve 72, and the second section 100*b* in the order to bypass the fan motor 85. In this manner, a flow rate of the hydraulic fluid to be supplied to the fan motor 85 is controlled.

In addition, by regulating the flow rate (pressure) of the hydraulic fluid flowing in the bypass fluid passage 100, the flow rate of the hydraulic fluid to be supplied to the fan driving device 25B through the second introduction port 94*a*, the pump fluid passage 99, the output port 94*b*, and the first external fluid passage 97 is regulated. That is, the flow rate of the hydraulic fluid to be supplied to the fan motor 85 is regulated. By regulating the flow rate of the hydraulic fluid to be supplied to the fan motor 85, a rotation speed of the first fan 25A can be regulated (controlled).

The unloading valve 71 is constituted of a solenoid valve. In detail, the unloading valve 71 is constituted of a solenoid opening/closing valve having the solenoid 71*a*, and is mounted in parallel with the flow rate control valve 72. The solenoid 71*a* (unloading valve 71) is connected to the controller 47. The controller 47 outputs a control signal to the unloading valve 71 to control the unloading valve 71. In detail, the unloading valve 71 is capable of being shifted between two positions: the full-closing position (OFF position) 71*b* and the full-opening position (ON position) 71*c*. The unloading valve 71 is held in the full-closing position 71*b* by a biasing force of a spring 71*d*, and is shifted to the full-opening position 71*c* when the magnetic force generated by the electric current applied to the solenoid 71*a* overcomes the biasing force of the spring 71*d*. The full-closing position 71*b* is a position to close the unloading fluid passage 101 (second internal fluid passage 96), and the full-opening position 71*c* is a position to open the unloading fluid passage 101 (second internal fluid passage 96).

By fully closing the flow rate control valve 72 and shifting the unloading valve 71 to the full-closing position 71*b*, most of the hydraulic fluid flowing from the first introduction port 86*a* flows into the fan motor 85. In this manner, a fan rotation speed, which is the rotation speed of the first fan 25A, becomes the maximum rotation speed. In addition, in this manner, by shifting the unloading valve 71 to the full-opening position 71*c*, most of the hydraulic fluid flowing to the pump fluid passage 99 is discharged from the second discharge port 94*c*. This causes the fan rotation speed to become the minimum rotation speed (including zero speed). That is, when the unloading valve 71 is shifted to the full-opening position 71*c*, the rotation speed of the first fan device 25 will be in a stopping or substantially-stopping state. When the fan rotation speed is set to the minimum rotation speed, both the unloading valve 71 and the flow rate control valve 72 may be opened.

In addition, the fan rotation speed can be changed by shifting the unloading valve 71 to the full-closing position 71*b* and regulating an opening degree of the flow rate control valve 72 to regulate a flow rate of the hydraulic fluid flowing in the bypass fluid passage 100.

The first fan device 25, for example, controls the rotation speed to lower the temperatures of the refrigerant, cooling water, or hydraulic fluid, which represent the temperature of the cooled objects 83 (controls the rotation number based on the temperature of the cooled objects 83), and controls the rotation speed based a load acting on the engine 6 (difference between the target rotation speed of the engine 6 and the actual engine rotation speed that is an actual rotation speed of the engine 6).

In the above embodiment, the unloading valve 71 is provided so that the minimum rotation speed of the fan can be lower than the minimum rotation speed of the fan defined only by the flow rate control valve 72. However, it is also possible to control the fan rotation speed from the minimum rotation speed to the maximum rotation speed only with the flow rate control valve 72 without the unloading valve 71. Accordingly, the fan rotation controller 70 may be configured to incorporate only the flow rate control valve 72 without incorporating the unloading valve 71.

For example, it is conceivable that the flow rate control valve 72 and the unloading valve 71 are incorporated in the fan driving device 25B; however, in the fan driving device 25B with the flow rate control valve 72 and the unloading valve 71 incorporated therein, three valves which are the directional control valve 73, the flow rate control valve 72, and the unloading valve 71 are mounted in a limited space inside the motor housing 86, and thus the forming of the internal fluid passage is highly restricted. Accordingly, in the fan driving device 25B with the flow rate control valve 72 and the unloading valve 71 incorporated therein, the internal fluid passage may fail to have a sufficient inner diameter when trying to form the fan driving device 25B compactly, and thus a pressure loss (horsepower loss) may become large.

In contrast, in the present embodiment, the flow rate control valve 72 and the unloading valve 71 are incorporated in the valve housing 94 which is disposed separately from the fan driving device 25B, and are separately located from the fan driving device 25B. In this manner, an inner diameter of the internal fluid passage can be secured sufficiently, and the pressure loss (horsepower loss) in the hydraulic circuit can be reduced.

In addition, when it is tried to form the fan driving device 25B compactly by incorporating the flow rate control valve 72 and the unloading valve 71 in the fan driving device 25B, the pressure loss may increase due to the viscosity of the hydraulic fluid at low temperature. Accordingly, since there is a possibility that the second pump P2 disposed upstream of the fan motor 85 may be pressurized at an allowable pressure or higher, a protective relief valve for protection is required to be disposed in the vicinity of the second pump P2, which includes a large cost impact.

In contrast, in the present embodiment, the flow rate control valve 72 and the unloading valve 71 are incorporated in the valve housing 94, and are located separately from the fan driving device 25B, so that the inner diameter of the internal fluid passage can be secured sufficiently. Accordingly, the pressure at low temperature can be reduced, and thus the protective relief valve disposed in the vicinity of the second pump P2 can be eliminated.

In addition, in the fan driving device 25B with the flow rate control valve 72 and the unloading valve 71 incorporated therein, lengths of hydraulic hoses in a section between the second pump P2 and the fan driving device 25B (referred to as a first arrangement section) and another section between the fan driving device 25B and the hydraulic filter 89 (referred to as a second arrangement section) may become long due to layout restrictions. The longer the lengths of the hydraulic hoses in the first and second arrangement sections become, the greater the pressure losses in the first and second arrangement sections caused when the unloading valve 71 is activated become.

In contrast, in the present embodiment, the fan rotation controller 70, which is placed separately from the fan driving device 25B, can be located without influence by the layout restriction of the fan driving device 25B, thereby reducing the pressure loss, which is caused when the unloading valve 71 is activated, in a section between the second pump P2 and the hydraulic filter 89 (a section between the second pump P2 and the fan rotation controller 70, section between the fan rotation controller 70 and the fan driving device 25B, and section between the fan driving device 25B and the hydraulic filter 89) as much as possible.

As shown in FIG. 8, the first fan device 25 and the fan rotation controller 70 are located inside the machine body 2. The first fan device 25 is located above the engine 6. In addition, the first fan device 25 is housed in an air guide duct 108. The cooled objects 83 including the radiator 24, the condenser 27, and the oil cooler is located above the air guide duct 108 (first fan device 25). By the first air flow FL1 generated by the first fan device 25, outside air is introduced into the air guide duct 108 from above the cooled objects 83 through the cooled objects 83 and is discharged from the air guide duct 108 to the outside of a lateral side of the machine body 2.

The hydraulic filter 89 is located forward of the air guide duct 108. In detail, the hydraulic filter 89 is located above the HST pump HP, specifically on a lateral side (right side) of the HST pump HP.

The above-mentioned relief valve 106, which protects the hydraulic filter 89, is located in the vicinity of the hydraulic filter 89. In detail, as shown in FIG. 8, the relief valve 106 is located forward of and below the hydraulic filter 89.

The pump unit PU, the hydraulic filter 89, and the fan rotation controller 70 are located outside the air guide duct 108.

The fan rotation controller 70 is, for example, located in the vicinity of the pump unit PU. In the example shown in the drawings, the fan rotation controller 70 is located above the front of the pump unit PU, specifically at the lateral side (right side) of a front portion of the pump unit PU. In the present embodiment, the fan rotation controller 70 and the hydraulic filter 89 are located on the same lateral side (right side) in the machine width direction.

The location of the fan rotation controller 70 is not limited to the location shown in FIG. 8, and may be located anywhere inside the machine body 2. For example, the fan rotation controller 70 (valve housing 94) may be attached to the pump unit PU. The fan rotation controller 70 may also be located outside the machine body 2. That is, the fan rotation controller 70 can be located freely without being restricted by the locations of other devices.

In the above locational configuration of hydraulic components and the like, the fan rotation controller 70 (unloading valve 71) is disposed in a fluid passage (delivery fluid passage 81, first section 100*a*, second section 100*b*, first part 101*a*, second part 101*b*, second external fluid passage 98, and the like) connecting the pump unit PU (second pump P2) to the hydraulic filter 89 at a short distance. Referring to FIG. 8, for this short fluid passage, the fluid passage from the fan rotation controller 70 to the hydraulic filter 89 through the first fan device 25 extends from the fan rotation controller 70 to the first fan device 25 via the air guide duct 108 and returns from the first fan device 25 to the hydraulic filter 89 via the air guide duct 108.

The relief valve 106 is disposed in the vicinity of the hydraulic filter 89 to protect the hydraulic filter 89.

As the section (delivery fluid passage 81) between the second pump P2 and the fan rotation controller 70 (unloading valve 71), through which the whole amount of the hydraulic fluid delivered from the second pump P2 flows, a thick hose is employed. As the fluid passage with a low flow rate downstream of the fan rotation controller 70 (unloading valve 71) and the fluid passage downstream of the first fan device 25 (fan motor 85), hoses thinner than the hose forming the delivery fluid passage 81 are employed.

As shown in FIG. 4, another fan device (referred to as a second fan device) 26 different from the first fan device 25 is located on the other directional surface side X2 (opposite to the location side of the first fan device 25) of the cooled objects 83. The second fan device 26 is an electric fan to be driven by an electric power supplied from a battery or the like mounted on the machine body 2.

The second fan device 26 includes a fan (referred to as a second fan) 26A and an electric motor 26B for driving the second fan 26A.

The second fan 26A includes a plurality of blades radially disposed on an outer circumference of a center boss and rotates to generate air flow. In addition, the second fan 26A rotates in the same direction as the second direction when the electric motor 26B is driven by an electric power. That is, the second fan device 26 generates the second air flow FL2 flowing in a direction from the one directional surface side X1 of the cooled objects 83 toward the other directional surface side X2. The second fan device 26 is capable of rotating only in the second direction and generating the second air flow FL2, but is incapable of generating the first air flow FL1.

The rotation axis center of the second fan device 26 is located on a straight line coaxial to the rotation axis center of the first fan device 25. In addition, the second fan device 26 is connected to the controller 47. The controller 47 outputs a control signal to the second fan device 26 to turn the second fan device 26 to be an on state or an off state. The ON state is a state where the second fan device 26 rotates, and the OFF state is a state where the second fan device 26 stops.

In the present embodiment, in order to cool the cooled objects 83 (radiator 24, condenser 27, oil cooler), the first fan device 25 is rotated normally to generate the first air flow FL1; however, the second fan device 26 is not rotated. That is, when the first fan device 25 is rotated normally to generate the first air flow FL1, the rotation of the second fan 26A is stopped.

In order to blow the dusts adhering to the cooled objects 83, the first fan device 25 is rotated reversely to generate the second air flow FL2; however, the rotation of the first fan device 25 alone may be incapable of generating a sufficient air volume to blow the dusts. In particular, since the air volume generated near the center of the first fan 25A (a portion close to the rotation axis) is smaller than the air volume generated near the outer circumference (a portion away from the rotation axis), the dusts in the portion near the center may be failed to be sufficiently blown.

Therefore, in order to blow the dusts adhering to the cooled objects 83, the second fan device 26 is also rotated to generate the second air flow FL2 with the second fan device 26. The air volume generated by the rotation of the second fan device 26 can compensate for the insufficient air volume generated only by the rotation of the first fan device 25. That is, the rotation of the second fan device 26 increases the air volume of the second air flow FL2 flowing in the direction from the one directional surface side X1 of the cooled objects 83 to the other directional surface side X2. Accordingly, the dusts that cannot be blown only by the rotation of the first fan device 25 can be blown away.

As shown in FIG. 4, a first switch 64A, a second switch 64B, and an operation member 64C are connected to the controller 47. The controller 47 can obtain operation signals output from the first switch 64A, the second switch 64B, and the operation member 64C.

The "dust cleaning" of blowing dusts by the second air flow FL2 of the first and second fan devices 25 and 26 may be performed automatically or manually by an operator.

In the case where the "dust cleaning" is performed automatically, the controller 47 automatically performs the "dust cleaning" for a predetermined period at time intervals set in advance by the user (operator). That is, a reversing operation of the first fan device 25 and the rotational driving of the second fan device 26 are automatically performed at the set time intervals (e.g., every 10 minutes, every 20 minutes . . . every 90 minutes, etc.). For example, when the time intervals are set to 60 minutes, the "dust cleaning" will be automatically performed every 60 minutes. The time intervals to be set can be selected from a plurality of the set time intervals. It is also possible to set the time intervals in a non-step manner. The time intervals can be set by the operation member 64C connected to the controller 47.

When the "dust cleaning" is performed through the manual operation by an operator, the "dust cleaning" is performed by the operator turning on the first switch 64A. That is, the "dust cleaning" is instantaneously started manually at the timing when the operator operates the first switch 64A.

In addition, when the "dust cleaning" is performed, the second switch 64B can be turned on to cancel the "dust cleaning".

A switch may be provided to select either an operation to automatically perform the "dust cleaning" or an operation not to automatically perform the "dust cleaning".

Next, the operations of the flow rate control valve 72, directional control valve 73, second fan device 26, and unloading valve 71 to perform the "dust cleaning" will be described.

Figure 5:
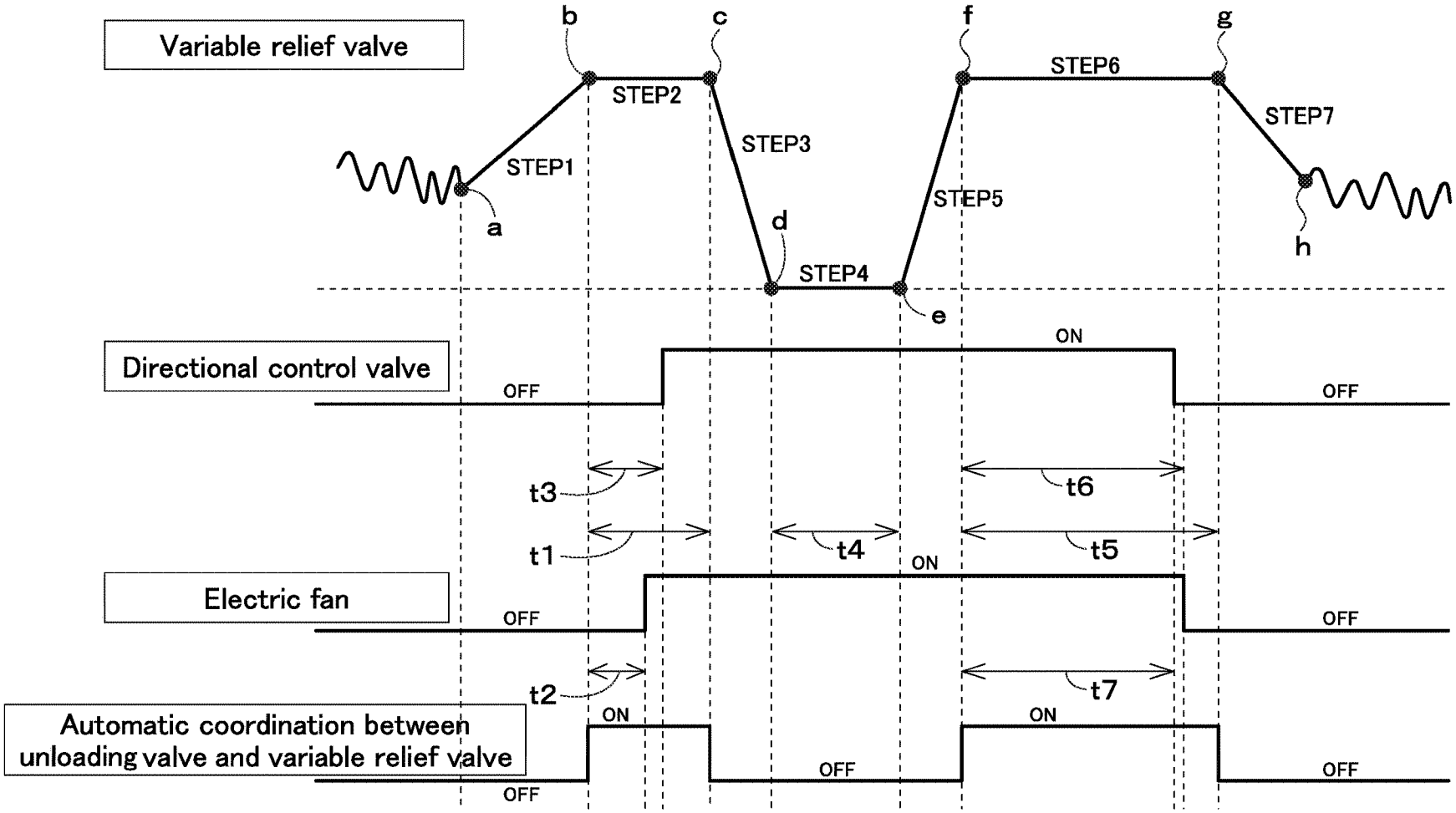
FIG. 5 is a time chart showing operations of a flow rate control valve, a directional control valve, a second fan device, and an unload valve during dust cleaning.

FIG. 5 is a view showing an example of an operation pattern of the flow rate control valve 72, directional control valve 73, second fan device 26, and unloading valve 71 which are controlled by the controller 47, where the horizontal axis is a time axis.

In FIG. 5, a point "a" represents a starting point at which the first switch 64A is operated or at which the "dust cleaning" is automatically started. When the "dust cleaning" is started according to a control signal from the controller 47, the flow rate control valve 72 first is gradually opened under a state where the unloading valve 71 is off (full-closing position 71*b*), and at a time point (point "b") at which the flow rate control valve 72 is fully opened, the unloading valve 71 is shifted to the full-opening position 71*c* by operating the unloading valve 71 to be on, and then the rotation speed of the first fan 25A is set to the minimum rotation speed (STEP 1). That is, when the flow rate control valve 72 is gradually opened under a state where the unloading valve 71 is in the full-closing position 71*b* and then the flow rate control valve 72 is fully opened, the unloading valve 71 is shifted to the full-opening position 71*c*.

Next, the state where the flow rate control valve 72 is fully opened and the unloading valve 71 is in the full-opening position 71*c* is continued for a predetermined time t1 (STEP 2). That is, the rotation speed of the first fan 25A is maintained at the minimum rotation speed for a predetermined time t1.

Then, during the continuous maintaining the rotation speed of the first fan 25A at the minimum rotation speed (between the point "b" and the point "c"), the directional control valve 73 is shifted to the second position 73*c* by turning-on the directional control valve 73. That is, the controller 47 outputs a control signal to the directional control valve 73 to switch a rotation direction of the first fan 25A in switching a flow direction of the hydraulic fluid driving the fan motor 85 under a state where the flow rate control valve 72 is gradually opened and the flow rate control valve 72 is fully opened to reduce the rotation speed of the first fan 25A to the minimum rotation speed. In the present embodiment, the controller 47 outputs a control signal to the directional control valve 73 to switch the rotation direction of the first fan device 25 under a state where the flow rate control valve 72 is fully opened and the unloading valve 71 is shifted to the full-opening position 71*c* to reduce the rotation speed of the first fan 25A to the minimum rotation speed.

In addition, when the rotation speed of the first fan 25A is reduced to the minimum rotation speed, the controller 47 turns on the second fan device 26 to rotate the second fan 26A.

The rotation (start of rotation) of the second fan 26A (second fan device 26) can be performed before or after the rotation speed of the first fan 25A (first fan device 25) is reduced to the minimum rotation speed.

In the present embodiment, an elapsed time t2 from the STEP2 start point (point "b") to the turning-on of the second fan device 26 is shorter than an elapsed time t3 from the STEP2 start point (point "b") to the turning-on of the directional control valve 73. That is, the tuning-on of the second fan device 26 is performed before the rotation direction of the first fan 25A is switched. In other words, the controller 47 outputs a control signal to the directional control valve 73 to switch the rotation direction of the first fan 25A after the rotation of the second fan 26A is started.

It is possible to output a control signal to the directional control valve 73 to switch the rotation direction of the first fan 25A (first fan device 25) before starting the rotation of the second fan 26A (second fan device 26). In addition, the start of rotation of the second fan 26A and the switching of the directional control valve 73 can be performed simultaneously.

Next, the controller 47 turns off the unloading valve 71 at a time point (point "c") at which a predetermined time has elapsed after the rotation direction of the first fan 25A is completely switched, thereby shifting the unloading valve 71 to the full-closing position 71*b*, and the controller 47 gradually closes the flow rate control valve 72 until the fan rotation speed reaches the maximum rotation speed (point "d") (STEP 3). In the example shown in FIG. 5, when the unloading valve 71 is turned off to be shifted to the full-closing position 71*b* (point "c"), the second fan device 26 has been turned on (rotating state).

Next, the rotation speed of the first fan 25A is maintained at the maximum rotation speed for a predetermined time t4 from a point "d" to a point "e" (STEP 4). At this time, the second fan device 26 has been turned on. That is, the second fan device 26 is rotating when the rotation speed of the first fan 25A is at the maximum rotation speed. In other words, the controller 47 rotates the second fan 26A in a direction in which the second air flow FL2 is generated in rotating the first fan 25A in the second direction. In this manner, an air volume by the first fan 25A and an air volume by the second fan 26A can blow the dusts well.

Next, the controller 47 gradually opens the flow rate control valve 72 from a time point (point "e") of the end of STEP 4, the unloading valve 71 is turned on to shift the unloading valve 71 to the full-opening position 71*c* at a time point (point "f") at which the flow rate control valve 72 is fully opened, and thus the rotation speed of the first fan 25A is set to the minimum rotation speed (STEP 5). In the example shown in FIG. 5, when the flow rate control valve 72 is fully opened and the unloading valve 71 is shifted to the full-opening position 71*c* (point "f"), the second fan device 26 is in the rotating state.

Next, the state where the flow rate control valve 72 is fully opened and the unloading valve 71 is shifted to the full-opening position 71*c* is maintained for a predetermined time t5 (STEP 6). That is, the rotation speed of the first fan 25A is maintained at the minimum rotation speed for the predetermined time t5.

Then, while the rotation speed of the first fan 25A is continued at the minimum rotation speed (between the point "f" and a point "g"), the directional control valve 73 is turned off to be shifted to the first position 73*b*.

Even in this case, the controller 47 outputs a control signal to the directional control valve 73 to switch the rotation direction of the first fan 25A in switching a flow direction of the hydraulic fluid driving the fan motor 85 under a state where the flow rate control valve 72 is gradually opened and the flow rate control valve 72 is fully opened to reduce the rotation speed of the first fan 25A to the minimum rotation speed. In the present embodiment, the controller 47 outputs a control signal to the directional control valve 73 to switch the rotation direction of the first fan device 25 under a state where the flow rate control valve 72 is fully opened and the unloading valve 71 is shifted to the full-opening position 71*c* to reduce the rotation speed of the first fan 25A to the minimum rotation speed.

In addition, during this continuation of maintaining the rotation speed of the first fan 25A at the minimum rotation speed (between the point "f" and the point "g"), the rotation of the second fan 26A is stopped by turning-off the second fan device 26. An elapsed time t6 from a time point of start of STEP6 (point "f") to the turning-off of the second fan device 26 is longer than an elapsed time t7 from the time point of start of STEP6 (point "f") to the turning-off the directional control valve 73. That is, the second fan device 26 is turned off after the rotation direction of the first fan 25A is completely switched. In other words, the controller 47 outputs a control signal to the directional control valve 73 to switch the rotation direction of the first fan 25A, and then stops the rotation of the second fan 26A.

The rotation of the second fan 26A (second fan device 26) may be stopped before outputting the control signal to the directional control valve 73 to switch the rotation direction of the first fan 25A (first fan device 25). In addition, the switching of the directional control valve 73 and the stopping of the rotation of the second fan 26A may be performed simultaneously.

In addition, the stopping of the rotation of the second fan 26A (second fan device 26) may be performed before the rotation speed of the first fan 25A (first fan device 25) is reduced to the minimum rotation speed and between the time point of the end of STEP 4 (point "e") and the time point (point "f") at which the flow rate control valve 72 is fully opened. In addition, the stopping of the rotation of the second fan 26A (second fan device 26) may be performed after the rotation speed of the first fan 25A (first fan device 25) is reduced to the minimum rotation speed.

Next, after shifting the unloading valve 71 to the full-closing position 71*b* by turning-off the unloading valve 71 at the time point of the end of STEP 6 (point "g"), the flow rate control valve 72 is gradually closed to increase the rotation speed of the first fan 25A to the target rotation speed of the first fan 25A, which is set based on the temperatures of the refrigerant, cooling water, and hydraulic fluid that ate the temperatures of the cooled objects 83 and on a load acting on the engine 6 (STEP 7).

After the time point (point "h") at which the "dust cleaning" is completed, the "dust cleaning" is canceled, and automatic control of the rotation speed of the first fan device 25 is performed based on the temperatures of the refrigerant, cooling water, and hydraulic fluid defined as the temperatures of the cooled objects 83 and based on a load acting on the engine 6.

In the conventional technique, for example, when the rotation speed of the fan motor 85 is high at the time where the rotation direction of the fan motor 85 is shifted from the normal rotation direction to the reverse rotation direction to perform the "dust cleaning", a surge pressure is generated in the second pump P2 and the like disposed upstream of the fan motor 85.

The operations of the flow rate control valve 72, the directional control valve 73, and the second fan device 26 in performing the "dust cleaning" described above can be carried out in the substantially-same manner without the unloading valve 71.

In the present embodiment, the flow rate control valve 72 is fully opened, and the unloading valve 71 is shifted to the full-opening position 71*c* to reduce the rotation speed of the first fan 25A to the minimum rotation speed, that is, the rotation speed of the first fan 25A is sufficiently reduced, and then a control signal is output to the directional control valve 73 to switch the rotation direction of the first fan 25A. In this manner, the generation of surge pressure in the hydraulic circuit can be suppressed well at the time of switching the rotation direction of the fan motor 85.

In addition, in a case of lowering the rotation speed of the first fan 25A to the minimum rotation speed, when a speed of lowering the rotation speed of the first fan 25A (speed of increasing an electric current) is made too fast (rapid pressure reduction by the unloading valve 71 or the flow rate control valve 72), a surge pressure may be generated in a hydraulic device such as the hydraulic filter 89 disposed downstream of the fan motor 85. In the present embodiment, however, the unloading valve 71 is controlled in combination with the flow rate control valve 72 to gently reduce the rotation speed of the first fan 25A. In this manner, it is possible to suppress the surge pressure from being generated in the hydraulic device disposed downstream of the fan motor 85.

In addition, when a speed of increasing the rotation speed of the first fan 25A (speed of reducing an electric current) is made too fast (rapid pressurization by the unloading valve 71 and the flow rate control valve 72) in increasing the rotation speed of the first fan 25A to the maximum rotation speed, there is a possibility that a surge pressure will be generated in a hydraulic device such as the second pump P2 disposed upstream of the fan motor 85. In the present embodiment, however, the unloading valve 71 is controlled in combination with the flow rate control valve 72 to gently increase the rotation speed of the first fan 25A. In this manner, it is possible to suppress the surge pressure from being generated in the hydraulic device disposed upstream of the fan motor 85.

As described above, by gently switching the rotation direction of the fan motor 85, a surge pressure can be suppressed from being generated in the hydraulic circuit, and the damage to the hydraulic device can be prevented. In addition, it can contribute to suppression of the generation of abnormal noise and suppression of the lost horsepower due to the pressurization in the hydraulic circuit.

In addition, in the second fan device 26 arranged in parallel with the first fan device 25, when the electric motor 26B is stopped, the second fan 26A may be configured so that the second fan 26A is kept unrotatable or the second fan 26A is allowed to rotate freely. In the case where the second fan 26A is allowed to rotate freely, the second fan 26A may be rotated following the first air flow FL1 generated by the first fan 25A. When the second fan 26A rotates in accompany with the first fan 25A, a surge voltage may be generated in the electric circuit in turning on or off the second fan device 26.

In contrast, the second fan device 26 may be turned on or off under a state where the first fan device 25 rotates at the minimum rotation speed, or the second fan device 26 may be turned on or off at any optional timing as needed different from a timing when the first fan device 25 is rotating at the minimum rotation speed. In other words, the controller 47 rotates the second fan 26A (second fan device 26) when, before or after the reduced rotation speed of the first fan 25A (first fan device 25) reaches the minimum rotation speed.

Figure 6:
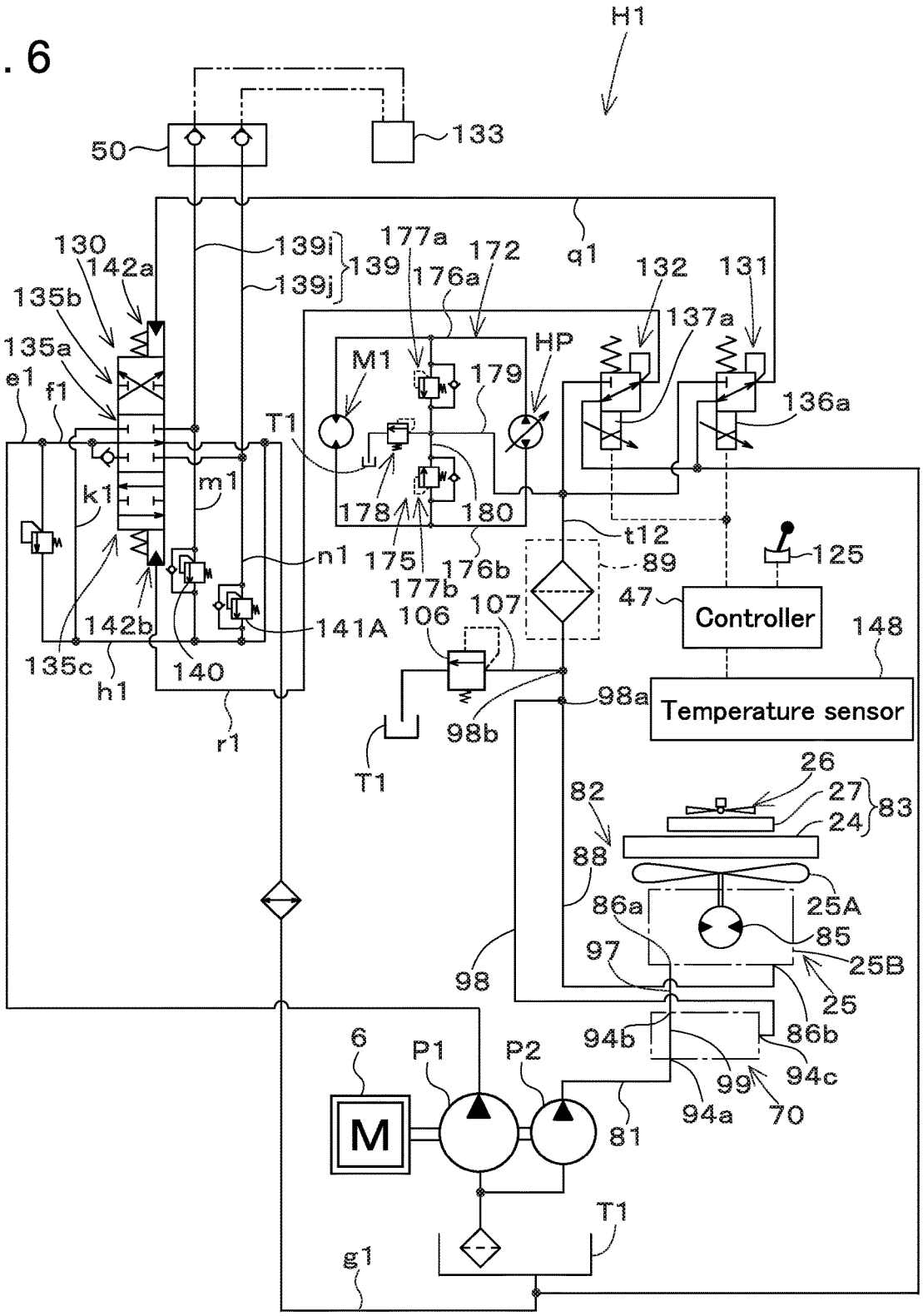
FIG. 6 is a circuit diagram showing a hydraulic control system according to another embodiment.

FIG. 6 shows the hydraulic control system H1 according to another embodiment.

The hydraulic control system H1 according to the embodiment shown in FIG. 6 includes an auxiliary control valve (referred to as a SP control valve) 130, and further includes auxiliary solenoid valves (referred to as SP solenoid valves) 131 and 132, which are a pair of solenoid valves for operating the SP control valve 130, and an HST 172, the auxiliary solenoid valves 131 and 132 and the HST 172 being disposed downstream of the cooling device 82. That configurations are different from the configurations of the hydraulic control system H1 according to the above-mentioned embodiment.

In the hydraulic control system H1 according to the other embodiment shown in FIG. 6, the cooling device 82 is disposed downstream of the second pump P2. In FIG. 6, the cooling device 82 is shown in a simplified form; however, the cooling device 82 is configured in the same manner as in the embodiment shown in FIG. 4 mentioned above. That is, the cooling device 82 includes the first fan device 25 configured to cool the cooled objects 83 and the fan rotation controller 70 configured to control the rotation of the first fan device 25. The first fan device 25 includes the first fan 25A and the fan driving device 25B having the fan motor 85 configured to drive the first fan 25A. A detailed description of the cooling device 82 is omitted.

In addition, the relief valve 106 and the hydraulic filter 89 are disposed downstream of the discharge flow passage 88 and the second external fluid passage 98. The controller 47 executes an operation of the fan rotation controller 70 (flow rate control valve 72) to rotate the first fan device 25 (fan 25A) at an appropriate rotation speed according to one or both of the fluid temperature and water temperature detected by a measuring device (temperature sensor) 148. In this manner, the controller 47 changes an amount of hydraulic fluid to be supplied to the primary side of the fan motor 85. The controller 47 and the measuring device 148 may be integrated.

As shown in FIG. 6, the first pump P1 is used to drive a hydraulic actuator 133 of an auxiliary attachment to be attached in place of the bucket 11. For convenience of explanation, the hydraulic actuator 133 of the auxiliary attachment is referred to as an auxiliary actuator. The operation member 125 for operating the auxiliary actuator 133 is connected to the controller 47.

The SP control valve 130 is a pilot-operated three-position switching valve with a direct-acting spool. The SP control valve 130 is shiftable to a neutral position 135*a*, a first position 135*b*, or a second position 135*c* with a pilot pressure. The SP control valve 130 is returned to the neutral position 135*a* by a spring.

The SP control valve 130 is connected to a working system supply fluid passage f1 that is connected to the delivery passage e1 of the first pump P1. In addition, the bypass fluid passage h1 is connected to the SP control valve 130 via the drain fluid passage k1, and the drain fluid passage g1 returning to the tank T1 side is also connected to the SP control valve 130.

In addition, a hydraulic fluid supply passage 139 is connected between the SP control valve 130 and the connecting member 50. The hydraulic fluid supply passage 139 includes two flow passages, which are a flow passage 139*i* connected to the bypass fluid passage h1 via the first relief passage m1, and a flow passage 139*j* connected to the bypass fluid passage h1 via the second relief passage n1. Relief valves 140 and 141A are provided on the first and second relief passages m1 and n1, respectively.

The connection member 50 connects the SP control valve 130 to the reserve actuator 133, and connects the SP control valve 130 to the reserve actuator 133 via the hydraulic fluid supply passage 139, the hydraulic hoses, and the like.

The SP solenoid valve 131 is connected, via a first pilot fluid passage q1, to a pressure receiving portion 142*a* disposed on one side of the SP control valve 130. The SP solenoid valve 132 is connected, via the second pilot fluid passage r1, to a pressure receiving portion 142*b* disposed on the other side of the SP control valve 130. The pilot fluid (pressured fluid) from the second pump P2 can be supplied to the SP solenoid valves 131 and 132 via the pilot pressure supply passage t12. Accordingly, when the SP control valve 130 is shifted to the first position 135*b* by the SP solenoid valve 131, the hydraulic fluid from the first pump P1 is supplied from the flow passage 139*i* to the reserve actuator 133, and a fluid returning from the reserve actuator 133 flows from the flow passage 139*j* to the drain fluid passage k1.

In addition, when the SP control valve 130 is shifted to the second position 135*c* by the SP solenoid valve 132, the hydraulic fluid from the first pump P1 is supplied from the flow passage 139*j* to the auxiliary actuator 133, and the fluid returning from the auxiliary actuator 133 flows from the flow passage 139*i* to the drain fluid passage k1.

In the hydraulic control system H1 described above, the auxiliary actuator 133 of the auxiliary attachment can be actuated via the SP control valve 130 by actuating the SP solenoid valves 131 and 132.

The SP solenoid valves 131 and 132 are controlled by the controller 47 mounted on the working machine 1. The controller 47 controls the SP solenoid valves 131 and 132 (SP control valve 130) according to an operation of a switch or the like disposed on the operation member 125.

In the hydraulic control system H1, the SP solenoid valves 131 and 132 are disposed downstream of the hydraulic filter 89. The pilot fluid (pressured fluid) discharged from the first fan device 25 (fan driving device 25B) and the fan rotation controller 70 and flowing through the hydraulic filter 89 is supplied to the SP solenoid valves 131 and 132 via the pilot pressure supply fluid passage t12.

The HST 172 includes the HST pump HP configured to be driven by the engine 6 and a traveling motor (HST motor) M1 connected to the HST pump HP by a pair of speed-shifting fluid passages 176*a* and 176*b* to form a closed circuit.

In addition, the HST 172 includes a charging circuit 175 that charges the hydraulic fluid to a lower-pressurized one of the speed-shifting fluid passages 176*a* and 176*b*. The charging circuit 175 includes high pressure relief valves 177*a* and 177*b* that release a pressure of a higher-pressurized one of the speed-shifting fluid passages 176*a* and 176*b* to the other lower-pressurized one of the speed-shifting fluid passages 176*a* and 176*b* when the higher-pressurized one of the shifting fluid passages 176*a* and 176*b* becomes a predetermined pressure or higher. The fluid passage 180 is connected to the pilot pressure supply fluid passage t12 via a charging fluid passage 179. Accordingly, the hydraulic fluid delivered from the second pump P2 to flow through the fan motor 85 and hydraulic filter 89 flows to the charging circuit 175 through the charging fluid passage 179. In addition, the charging circuit 175 includes a charging relief valve 178 configured to set a circuit pressure of the charging circuit 175, and the charging relief valve 178 is connected to the charging fluid passage 179 and the tank T1.

Figure 7:
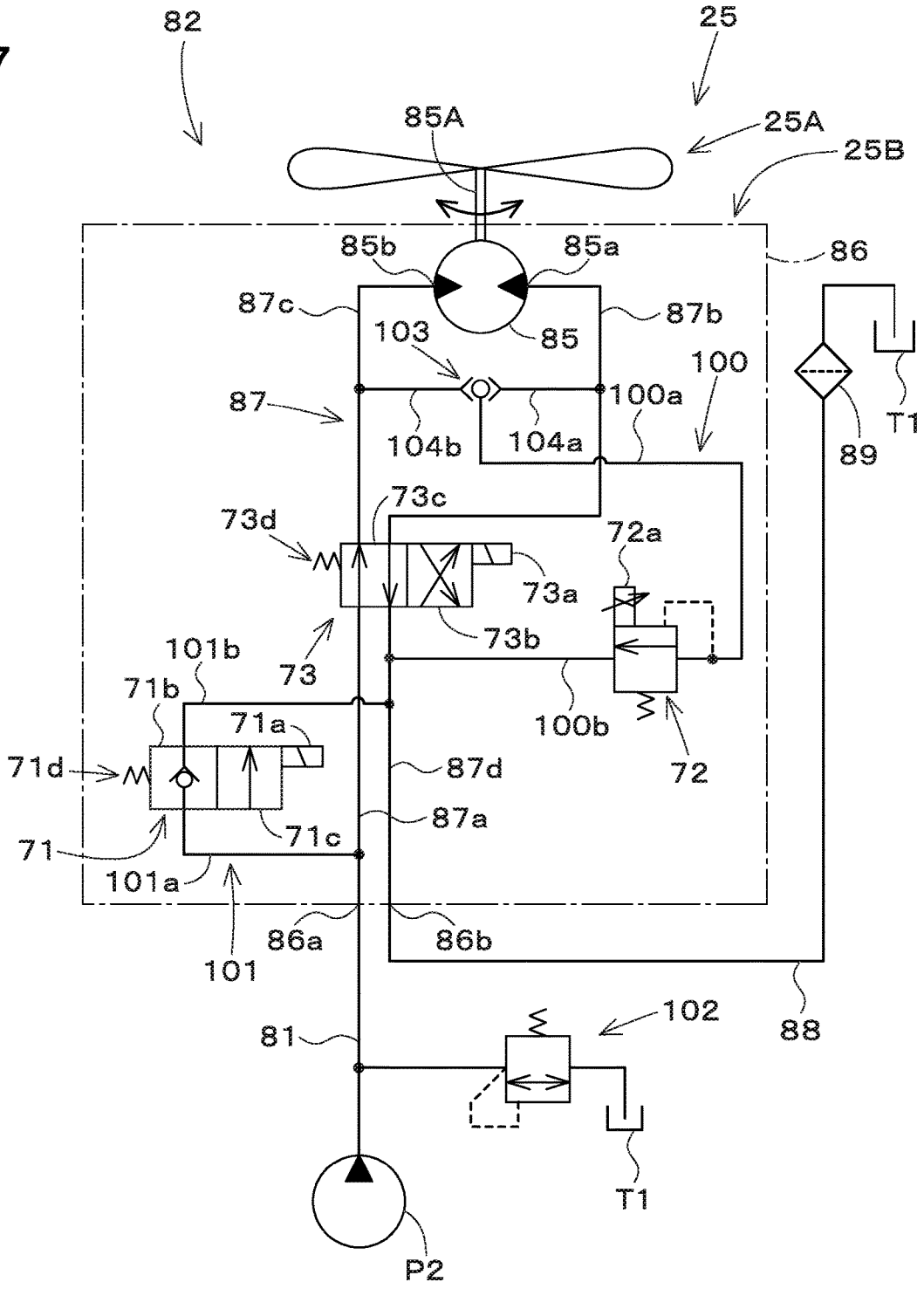
FIG. 7 is a circuit diagram showing a hydraulic circuit according to a modified example.

FIG. 7 shows a modified example of the first fan device 25.

In this modified example, the directional control valve 73, the flow rate control valve 72 and the unloading valve 71 are housed in the motor housing 86 that houses the fan motor 85. Accordingly, the bypass fluid passage 100 and the unloading fluid passage 101 are also formed in the motor housing 86. Accordingly, the cooling device 82 is constituted of the first fan device 25.

As shown in FIG. 7, the delivery fluid passage 81 is connected to the introduction port 86*a* of the motor housing 86. A discharge flow passage 88 is connected to the discharge port 86*b* of the motor housing 86.

In addition, the directional control valve 73 is held in the second position 73*c* by the biasing force of the spring 73*d*, and is shifted to the first position 73*b* when the magnetic force generated by the electric current applied to the solenoid 73*a* overcomes the biasing force of the spring 73*d*.

The first section 100*a* of the bypass fluid passage 100 is connected to the shuttle valve 103 and the flow rate control valve 72. The shuttle valve 103 is connected to the second fluid passage 87*b* via a first line 104*a* and to the third fluid passage 87*c* via a second line 104*b*. Accordingly, the hydraulic fluid to be supplied to the fan motor 85 flows to the flow rate control valve 72 through the shuttle valve 103. The second section 100*b* is connected to the fourth fluid passage 87*d* and the flow rate control valve 72. The hydraulic fluid that has flowed through the flow rate control valve 72 is discharged from the discharge port 86*b*.

The first portion 101*a* of the unloading fluid passage 101 is connected to the first fluid passage 87*a* and the unloading valve 71. The second portion 101*b* of the unloading fluid passage 101 is connected to the unloading valve 71 and the fourth fluid passage 87*d*. By shifting the unloading valve 71 to the full-opening position 71*c*, the hydraulic fluid flowing in the first fluid passage 87*a* is discharged to the discharge port 86*b*.

In addition, a relief valve 102 is connected to the delivery fluid passage 81.

The rest of configurations is configured in the same manner as those of the embodiment described above.

The working machine 1 according to the present embodiment includes the fan motor 60 driven with the hydraulic fluid, the fan motor 60 including the first port 60*a* and the second port 60*b*, the bypass fluid passage 53 fluidly connecting the first port 60*a* or vicinity thereof and the second port 60*b* or vicinity thereof to each other to bypass the fan motor 60, the flow rate control valve 54 provided on the bypass fluid passage 53 to control a flow rate of the hydraulic fluid flowing in the bypass fluid passage 53, the drain passage 55 configured to drain the hydraulic fluid upstream of the flow rate control valve 54, and the unloading valve 56 shiftable between the full-closing position 56*a* to close the drain passage 55 and the full-opening position 56*b* to open the drain passage 55.

According to this configuration, the rotation of the fan 49 rotated by the fan motor 60 can be reduced well.

In addition, the drain passage 55 is fluidly connected to the bypass fluid passage 53.

In addition, the unloading valve 56 is shifted from the full-opening position 56*b* to the full-closing position 56*a* when the flow rate control valve 54 is open at a predetermined opening degree.

According to this configuration, in shifting the unloading valve 56 from the full-opening position 56*b* to the full-closing position 56*a*, a surge pressure can be suppressed from being generated in the fan motor 60.

In addition, the flow rate control valve 54 is closed after a predetermined period elapses since the shifted unloading valve 56 reaches the full-closing position 56*a*.

According to this configuration, the operation of the fan 49 can be stabilized in increasing the rotation of the fan 49.

In addition, the unloading valve 56 is shifted from the full-opening position 56*b* to the full-closing position 56*a* while the flow rate control valve 54 open at a predetermined opening degree is gradually closed.

According to this configuration, in shifting the unloading valve 56 from the full-opening position 56*b* to the full-closing position 56*a*, a surge pressure can be suppressed from being generated in the fan motor 60.

In addition, an opening degree of the flow rate control valve 54 is changed to a predetermined opening degree while the unloading valve 56 is held at the full-opening position 56*b*.

According to this configuration, in a case where the unloading valve 56 is shifted from the full-opening position 56*b* to the full-closing position 56*a* for some reason under a state where the unloading valve 56 is held in the full-opening position 56*b*, a surge pressure can be suppressed from being generated in the fan motor 60.

In addition, the working machine 1 further includes the controller 47 that controls the flow rate control valve 54 and the unloading valve 56 by outputting control signals to the flow rate control valve 54 and the unloading valve 56. The controller 47 is configured or programed to output the first control signal to the unloading valve 56 so as to hold the unloading valve 56 at the full-opening position 56*b*, and to output the second control signal to the flow rate control valve 54 so as to set an opening degree of the flow rate control valve 54 to a predetermined opening degree while the unloading valve 56 is held at the full-opening position 56*b* by the first control signal.

According to this configuration, in a case where a supply of electric current is interrupted due to disconnection of a wire connected to the unloading valve 56 or the like, a surge pressure can be suppressed from being generated in the fan motor 60.

In addition, the bypass fluid passage 53 includes the first section (first connecting line) 53*a* fluidly connecting the first port 60*a* or the vicinity thereof to the flow rate control valve 54, and the second section (second connecting line) 53*b* fluidly connecting the second port 60*b* or the vicinity thereof to the flow rate control valve 54. The drain passage 55 fluidly connects the first section 53*a* and the second section 53*b* to each other.

According to this configuration, a configuration of the fluid passage configuration can be simplified.

In addition, the working machine 1 includes the fan motor 60 driven with hydraulic fluid, the fan motor 60 including the first port 60*a* and the second port 60*b*, the bypass fluid passage 53 connecting the first port 60*a* of the fan motor 60 and the second port 60*b* to each other, the flow rate control valve 54 provided on the bypass fluid passage 53 to control a flow rate of the hydraulic fluid flowing in the bypass fluid passage 53, the drain passage 55 connected to the bypass fluid passage 53 and configured to drain the hydraulic fluid, and the unloading valve 56 shiftable between the full-closing position 56*a* to close the drain passage 55 and the full-opening position 56*b* to open the drain passage 55.

According to this configuration, the rotation of the fan 49 rotated by the fan motor 60 can be reduced well.

In addition, the working machine 1 includes the fan motor 60 driven with hydraulic fluid, the fan motor 60 including the first port 60*a* and the second port 60*b*, the bypass fluid passage 53 connecting the first port 60*a* of the fan motor 60 and the second port 60*b* to each other, the flow rate control valve 54 provided on the bypass fluid passage 53 to control a flow rate of the hydraulic fluid flowing in the bypass fluid passage 53, the drain passage 55 configured to drain the hydraulic fluid supplied to the fan motor 60, and the unloading valve 56 shiftable between the full-closing position 56*a* to close the drain passage 55 and the full-opening position 56*b* to open the drain passage 55.

According to this configuration, the rotation of the fan 49 rotated by the fan motor 60 can be reduced well.

The working machine 1 according to the present embodiment includes the fan driving device 25B that includes the motor housing 86 including the first introduction port 86*a*, and the fan motor 85 disposed in the motor housing 86 and configured to rotate with hydraulic fluid introduced into the first introduction port 86*a*. The working machine 1 includes the fan rotation controller 70 that includes the valve housing 94 disposed apart from the motor housing 86 and including the output port 94*b*, and the flow rate control valve 72 disposed in the valve housing 94 and configured to control a flow rate of hydraulic fluid introduced into the first introduction port 86*a*, and the external fluid passage 97 fluidly connecting the first introduction port 86*a* of the motor housing 86 to the output port 86*a* of the valve housing 94.

According to this configuration, the flow rate control valve 72 is housed in the valve housing 94, which is disposed separately from the motor housing 86 housing the fan motor 85, and is separately located from the fan driving device 25B, thereby sufficiently securing the inner diameter of the internal fluid passage to reduce a pressure loss in the hydraulic circuit.

In addition, the working machine 1 further includes the hydraulic pump P2 to deliver the hydraulic fluid. The valve housing 94 includes the second introduction port 94*a* into which the hydraulic fluid delivered from the hydraulic pump P2 is introduced, and the first internal fluid passage 95 fluidly connecting the output port 94*b* to the second introduction port 94*a* and provided thereon with the flow rate control valve 72.

According to this configuration, the fan rotation controller 70 including the flow rate control valve 72 can be formed in a simple configuration.

In addition, the valve housing 94 includes the second internal fluid passage 96 fluidly connected to the first internal fluid passage 95, the unloading valve 71 provided on the second internal fluid passage 96 and shiftable between the full-closing position 71*b* to close the second internal fluid passage 96 and the full-opening position 71*c* to open the second internal fluid passage 96, and the discharge port 94*c* fluidly connected to the second internal fluid passage 96 and configured to discharge the hydraulic fluid from the second internal fluid passage 96 therethrough.

According to this configuration, the unloading valve 71 is incorporated in the fan rotation controller 70, and the unloading valve 71 and the flow rate control valve 72 are disposed separately from the fan driving device 25B, thereby sufficiently securing the inner diameter of the internal fluid passage to reduce a pressure loss in the hydraulic circuit in comparison with a case where the directional control valve 73, the flow rate control valve 72, and the unloading valve 71 are incorporated in the fan driving device 25B.

In addition, the first internal fluid passage 95 includes the pump fluid passage 99 fluidly connecting the output port 94*b* to the second introduction port 94*a*, and the bypass fluid passage 100 branching from the pump fluid passage 99 to be fluidly connected to the discharge port 94*c*. The second internal fluid passage 96 includes the unloading fluid passage 101 branching from the pump fluid passage 99 to be fluidly connected to the discharge port 94*c*.

According to this configuration, the fan rotation controller 70 including the flow rate control valve 72 and the unloading valve 71 can be formed in a simple configuration.

In addition, the fan driving device 25B includes the directional control valve 73 disposed in the motor housing 86 and configured to select a direction of the hydraulic fluid introduced into the fan motor 85.

According to this configuration, since the flow rate control valve 72 is disposed separately from the fan driving device 25B, the inner diameter of the internal fluid passage formed in the motor housing 86 can be sufficiently secured even when the directional control valve 73 is housed in the motor housing 86.

The working machine 1 according to the present embodiment includes the first fan 25A rotated to generate an air flow, the fan motor 85 driven with hydraulic fluid to rotate the first fan 25A, the flow rate control valve 72 to control a flow rate of hydraulic fluid supplied to the fan motor 85, the directional control valve 73 configured to change a flow direction of the hydraulic fluid for driving the fan motor 85 so as to change a rotation direction of the first fan 25A, and the controller 47 to control the flow rate control valve 72 and the directional control valve 7. The controller 47, when changing the flow direction of hydraulic fluid for driving the fan motor 85, is configured or programmed to gradually open the flow rate control valve 72 until the flow rate control valve 72 becomes fully open to minimize a rotation speed of the first fan 25A, and to output a control signal to the directional control valve 73 to change the rotation direction of the first fan 25A while the rotation speed of the first fan 25A is minimized.

According to this configuration, a surge pressure can be suppressed from being generated in the hydraulic circuit well in switching a rotation direction of the fan motor 85.

In addition, the working machine 1 further includes the unloading fluid passage 101 to drain the hydraulic fluid supplied to the fan motor 85, and the unloading valve 71 provided on the unloading fluid passage 101 and shiftable between the full-closing position 71*b* to close the unloading fluid passage 101 and the full-opening position 71*c* to open the unloading fluid passage 101. The controller 47 capable of controlling the unloading valve 71 is configured or programmed to reduce the rotation speed of the first fan 25A to the minimum rotation speed by fully opening the flow rate control valve 72 and by shifting the unloading valve 71 to the full-opening position 71*c*.

According to this configuration, a rotation speed of the first fan 25A can be reduced sufficiently.

In addition, the controller 47 is configured or programmed to gradually open the flow rate control valve 72 while the unloading valve 71 is set at the full-closing position 71*b*, and to shift the unloading valve 71 to the full-opening position 71*c* after the gradually opened flow rate control valve 72 becomes fully open.

According to this configuration, a surge pressure can be suppressed from being generated by suppressing a sudden pressure reduction caused by the flow rate control valve 72 and the unloading valve 71 in reducing a rotation speed of the first fan 25A.

In addition, the controller 47 is configured or programmed to shift the unloading valve 71 to the full-closing position 71*b* and gradually close the flow rate control valve 72 after a predetermined period elapses since the rotation direction of the first fan 25A is changed.

According to this configuration, a surge pressure can be suppressed from being generated by suppressing a sudden pressurization caused by the flow rate control valve 72 and the unloading valve 71 in increasing a rotation speed of the first fan 25A.

In addition, the working machine 1 further includes the cooled objects 83 to be cooled by the first fan 25A, the first fan 25A being disposed on the one directional surface side X1 of the first fan 25A, and the second fan 26A disposed on the other directional surface side X2 of the cooled objects 83. The first fan 25A is configured to rotate in the first direction so as to generate the first air flow FL1 passing the cooled objects 83 from the other directional surface side X2 to the one directional surface side X1, and to rotate in the second direction opposite to the first direction so as to generate the second air flow FL2 passing the cooled objects 83 from the one directional surface side X1 to the other directional surface side X2. The controller 47 is configured or programmed to rotate the second fan 26A in a direction such as to generate the second air flow FL2 when the first fan 25A is rotated in the second direction.

According to this configuration, the second air flow FL2 generated by the first fan device 25 and the second air flow FL2 generated by the second fan device 26 can blow the dusts adhering to the cooled objects 83 well.

In addition, the controller 47 is configured or programmed to rotate the second fan 26A when, before or after the reduced rotation speed of the first fan 25A reaches the minimum rotation speed.

According to this configuration, in a case where the second fan 26A is configured to rotate in accompany with the first fan 25A under a state where the second fan device 26 is stopped, a surge voltage can be suppressed from being generated in the electric circuit by rotating the second fan 26A under a state where a rotation speed of the first fan 25A is reduced to the minimum rotation speed.

In addition, the controller 47 is configured or programmed to output a control signal to the directional control valve 73 so as to change the rotation direction of the first fan 25A after or before rotating the second fan 26A.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The invention claimed is:

1. A working machine comprising:
a fan motor driven with hydraulic fluid, the fan motor including a first port and a second port;
a bypass fluid passage fluidly connecting the first port or vicinity thereof and the second port or vicinity thereof to each other to bypass the fan motor;
a flow rate control valve provided on the bypass fluid passage to control a flow rate of the hydraulic fluid flowing in the bypass fluid passage;
a drain passage configured to drain the hydraulic fluid upstream of the flow rate control valve; and
an unloading valve shiftable between a full-closing position to close the drain passage and a full-opening position to open the drain passage.

2. The working machine according to claim 1, wherein the drain passage is fluidly connected to the bypass fluid passage.

3. The working machine according to claim 1, wherein the unloading valve is shifted from the full-opening position to the full-closing position when the flow rate control valve is open at a predetermined opening degree.

4. The working machine according to claim 3, wherein the flow rate control valve is closed after a predetermined period elapses since the shifted unloading valve reaches the full-closing position.

5. The working machine according to claim 1, wherein the unloading valve is shifted from the full-opening position to the full-closing position while the flow rate control valve open at a predetermined opening degree is gradually closed.

6. The working machine according to claim 1, wherein an opening degree of the flow rate control valve is changed to a predetermined opening degree while the unloading valve is held at the full-opening position.

7. The working machine according to claim 5, further comprising:

a controller that controls the flow rate control valve and the unloading valve by outputting control signals to the flow rate control valve and the unloading valve, wherein the controller is configured or programed to output a first control signal to the unloading valve so as to hold the unloading valve at the full-opening position, and to output a second control signal to the flow rate control valve so as to set an opening degree of the flow rate control valve to a predetermined opening degree while the unloading valve is held at the full-opening position by the first control signal.

8. The working machine according to claim 1, wherein the bypass fluid passage includes a first section fluidly connecting the first port or the vicinity thereof to the flow rate control valve, and a second section fluidly connecting the second port or the vicinity thereof to the flow rate control valve, and the drain passage fluidly connects the first section and the second section to each other.

9. A working machine comprising:

a fan driving device that includes a motor housing including a first introduction port, and a fan motor disposed in the motor housing and configured to rotate with hydraulic fluid introduced into the first introduction port;

a fan rotation controller that includes a valve housing disposed apart from the motor housing and including an output port, and a flow rate control valve disposed in the valve housing and configured to control a flow rate of hydraulic fluid introduced into the first introduction port; and an external fluid passage fluidly connecting the first introduction port of the motor housing to the output port of the valve housing.

10. The working machine according to claim 9, further comprising:

a hydraulic pump to deliver the hydraulic fluid, wherein the valve housing includes a second introduction port into which the hydraulic fluid delivered from the hydraulic pump is introduced, and a first internal fluid passage fluidly connecting the output port to the second introduction port and provided thereon with the flow rate control valve.

11. The working machine according to claim 10, wherein the valve housing includes a second internal fluid passage fluidly connected to the first internal fluid passage, an unloading valve provided on the second internal fluid passage and shiftable between a full-closing position to close the second internal fluid passage and a full-opening position to open the second internal fluid passage, and a discharge port fluidly connected to the second internal fluid passage and configured to discharge the hydraulic fluid from the second internal fluid passage therethrough.

12. The working machine according to claim 11, wherein the first internal fluid passage includes a pump fluid passage fluidly connecting the output port to the second introduction port, and a bypass fluid passage branching from the pump fluid passage to be fluidly connected to the discharge port, and the second internal fluid passage includes an unloading fluid passage branching from the pump fluid passage to be fluidly connected to the discharge port.

13. The working machine according to claim 9, wherein the fan driving device includes a directional control valve disposed in the motor housing and configured to select a direction of the hydraulic fluid introduced into the fan motor.

14. A working machine comprising:

a first fan rotated to generate an air flow;

a fan motor driven with hydraulic fluid to rotate the first fan;

a flow rate control valve to control a flow rate of hydraulic fluid supplied to the fan motor;

a directional control valve configured to change a flow direction of the hydraulic fluid for driving the fan motor so as to change a rotation direction of the first fan; and a controller to control the flow rate control valve and the directional control valve, wherein the controller, when changing the flow direction of hydraulic fluid for driving the fan motor, is configured or programmed to gradually open the flow rate control valve until the flow rate control valve becomes fully open to minimize a rotation speed of the first fan, and to output a control signal to the directional control valve to change the flow direction of the hydraulic fluid while the rotation sped of the first fan is minimized.

15. The working machine according to claim 14, further comprising:

an unloading fluid passage to drain the hydraulic fluid supplied to the fan motor; and an unloading valve provided on the unloading fluid passage and shiftable between a full-closing position to close the unloading fluid passage and a full-opening position to open the unloading fluid passage, wherein the controller capable of controlling the unloading valve is configured or programmed to reduce the rotation speed of the first fan to the minimum rotation speed by fully opening the flow rate control valve and by shifting the unloading valve to the full-opening position.

16. The working machine according to claim 15, wherein the controller is configured or programmed to gradually open the flow rate control valve while the unloading valve is set at the full-closing position, and to shift the unloading valve to the full-opening position after the gradually opened flow rate control valve becomes fully open.

17. The working machine according to claim 15, wherein the controller is configured or programmed to shift the unloading valve to the full-closing position and gradually close the flow rate control valve after a predetermined period elapses since the rotation direction of the first fan is changed.

18. The working machine according to claim 14, further comprising:

a cooled object to be cooled by the first fan, the first fan being disposed on one directional surface side of the first fan; and a second fan disposed on the other directional surface side of the cooled object, wherein the first fan is configured to rotate in a first direction so as to generate a first air flow passing the cooled object from the other directional surface side to the one directional surface side, and to rotate in a second direction opposite to the first direction so as to generate a second air flow passing the cooled object from the one directional surface side to the other directional surface side, and the controller is configured or programmed to rotate the second fan in a direction such as to generate the second air flow when the first fan is rotated in the second direction.

19. The working machine according to claim 18, wherein the controller is configured or programmed to rotate the second fan when, before or after the reduced rotation speed of the first fan reaches the minimum rotation speed.

20. The working machine according to claim 19, wherein the controller is configured or programmed to output a control signal to the directional control valve so as to change the rotation direction of the first fan after or before rotating the second fan.

* * * * *